US006255998B1

(12) United States Patent
Podger

(10) Patent No.: US 6,255,998 B1
(45) Date of Patent: Jul. 3, 2001

(54) LEMNISCATE ANTENNA ELEMENT

(76) Inventor: James Stanley Podger, 55 Gradwell Drive, Scarborough, ON (CA), M1M 2N1

( * ) Notice: Subject to any disclaimer, the term of this patent is extended or adjusted under 35 U.S.C. 154(b) by 0 days.

(21) Appl. No.: 09/583,569

(22) Filed: May 31, 2000

(30) Foreign Application Priority Data

Mar. 30, 2000 (CA) ..... 2303703

(51) Int. Cl.[7] ..... H01Q 11/12
(52) U.S. Cl. ..... 343/867; 343/742
(58) Field of Search ..... 343/867, 866, 343/731, 732, 737, 741, 797

(56) References Cited

U.S. PATENT DOCUMENTS

| | | | | |
|---|---|---|---|---|
| D. 213,375 | | 2/1969 | Habig | D26/14 |
| 2,537,191 | | 1/1951 | Moore | 250/33.67 |
| 2,615,005 | | 10/1952 | White | 250/33.57 |
| 3,210,767 | | 10/1965 | Isbell | 343/792.5 |
| 3,268,899 | | 8/1966 | Walden | 343/741 |
| 3,434,145 | | 3/1969 | Wells | 343/726 |
| 3,573,832 | * | 4/1971 | Callaghan | 343/742 |
| 5,142,292 | * | 8/1992 | Chang | 343/742 |
| 5,319,354 | * | 6/1994 | Myatt | 340/572 |
| 5,805,114 | * | 9/1998 | Podger | 343/742 |

OTHER PUBLICATIONS

Sykes, B., "The Skeleton Slot Aerial System," *The Short Wave Magazine,* Jan. 1955, pp. 594–598.

Davey, W. W. "Try A Bi–Loop Antenna," *73 Magazine,* Apr. 1979, p. 58.

Hawker, J. Patrick, "Technical Topics, Double–Delta Aerials for VHF and UHF," *Radio Communications,* Jun. 1969, pp. 396–397.

Kraus, J. D., "A Small But Effective 'Flat Top' Beam," *Radio,* Mar. 1937, pp. 56–58.

Podger, J. S., Analysis Results, *Double Delta for Comparison.*

Podger, J. S., Analysis Results, *Lemniscate for Comparison.*

* cited by examiner

*Primary Examiner*—Don Wong
*Assistant Examiner*—James Clinger

(57) ABSTRACT

An antenna element is disclosed that is a pair of approximately coplanar loops, having perimeters of approximately one wavelength, that are connected at one point. The loops are positioned so that a line through center of one loop and that common point also is the line through the center of the other loop. The approximate shape of these loops is such that the distance from that common point to any point on either loop is proportional to the cosine, raised to some power, of a multiple of the angle between that center line and a line between the common point and the point on the loop. Compared to previous antenna elements constructed for the same purposes, antennas constructed with such loops can yield more directivity, particularly in the principal H plane, without producing large minor lobes of radiation. Several applications of such antenna elements in various arrays also are disclosed.

50 Claims, 10 Drawing Sheets

Fig. 2
Prior Art
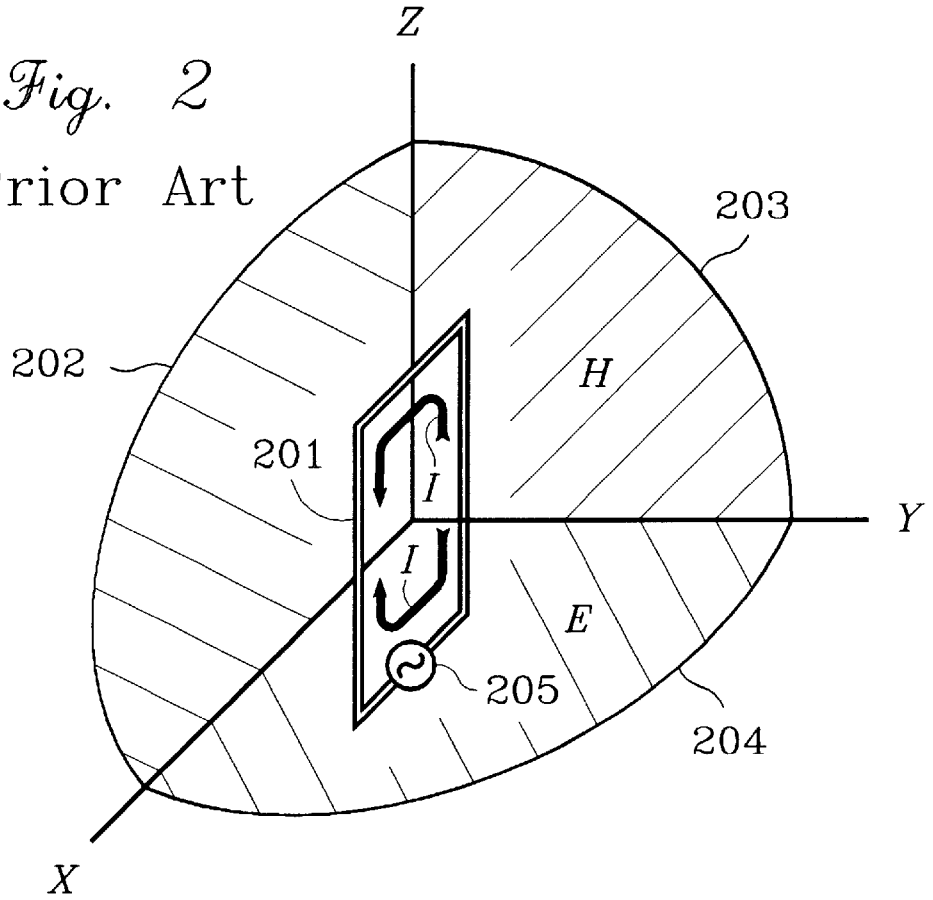
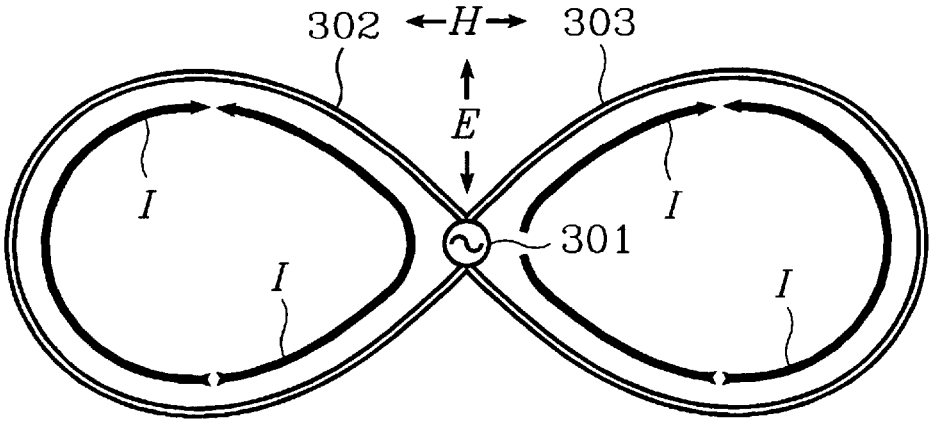
Fig. 3

LEMNISCATE ANTENNA ELEMENT

FIELD OF THE INVENTION

This invention relates to antenna elements, specifically antenna elements that are pairs of loops one-wavelength in perimeter. Such antenna elements can be used alone or in combinations to serve many antenna needs. One object of the invention is to achieve a superior transmitting and receiving ability, the gain, in some desired direction. Particularly, an object is to enhance that ability at elevation angles close to the horizon. Another object is to decrease the transmitting and receiving ability in undesired directions. Yet another object is to produce antennas that operate satisfactorily over greater ranges of frequencies.

This is the U.S. version of Canadian patent application 2,303,703.

Previous disclosures have shown that loops of conductors approximately one wavelength in perimeter yield advantages over more traditional straight conductors approximately one-half wavelength long. Particularly, these loops produce more gain over wider ranges of frequencies. Since the 1950's, it has been disclosed that pairs of such loops, particularly triangular loops, produce even more gain and reduce radiation in undesired directions even more. This disclosure presents the merit of two-loop antenna elements having shapes similar to the curve that mathematicians call a lemniscate. Those antenna elements will hereinafter be called lemniscate antenna elements.

LIST OF DRAWINGS

The background of this invention as well as the objects and advantages of the invention will be apparent from the following description and appended drawings, wherein:

FIG. 2 illustrates the conventional principal planes passing through a rectangular loop antenna;

FIG. 3 illustrates the front view of the basic lemniscate antenna element, and best illustrates the essence of the invention;

PRIOR ART

Figure 1A:
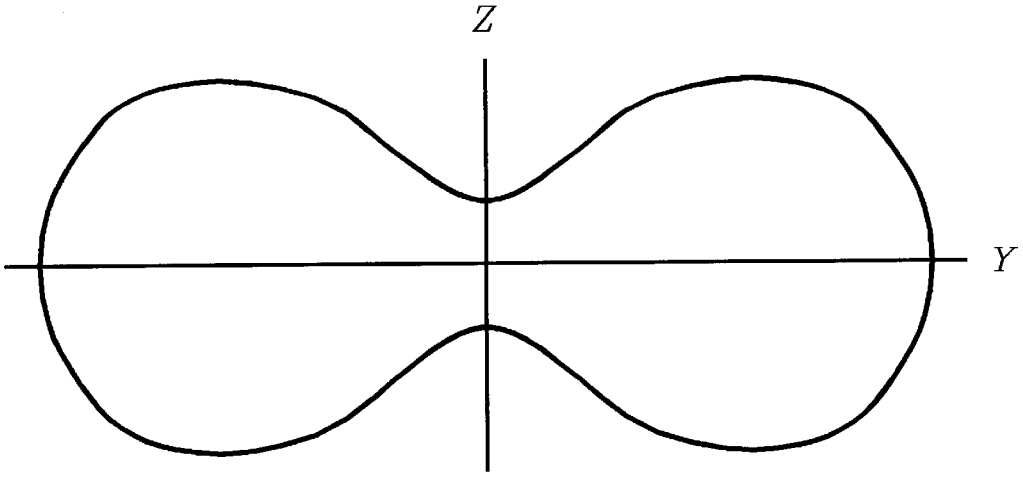
Prior Art Fig. 1A
FIGS. 1A, 1B and 1C illustrate some possible simplified radiation patterns of antennas.

There have been many antennas proposed in the literature based on loops approximately one wavelength in perimeter, but there seems to be less discussion of the reasons why some antenna elements are better than other ones. In order to understand the present disclosure, it is important to review and evaluate these previous elements. The following discussion will deal with the merits of single loops and pairs of loops, particularly pairs of triangular loops. Then it will be possible to show the merit of lemniscate-shaped loops.

Prior Art—Single Loops

The classical elementary antenna element, called a half-wave dipole antenna, is a straight conductor approximately one-half wavelength long. One of its disadvantages is that it transmits or receives equally well in all directions perpendicular to the conductor. That is, in the transmitting case, it does not have much gain because it wastes its ability to transmit in desired directions by sending signals in undesired directions. Another disadvantage is that it occupies a considerable space from end-to-end, considering that its gain is low. A third disadvantage is that it is susceptible to noise caused by precipitation. Yet another disadvantage is that if a high transmitter power were applied to it, in some climatic conditions, the very high voltages at the ends of the conductor could ionize the surrounding air producing corona discharges. These discharges could remove material from the conductor ends and, therefore, progressively shorten the conductor.

A worthwhile improvement has been achieved by using loops of various shapes that are one-wavelength in perimeter. Some examples are in the U.S. Pat. No. 2,537,191 by Clarence C. Moore, U.S. Pat. No. 3,268,899 by J. D. Walden, and U.S. Design Pat. Des. 213,375 by Harry R. Habig. Mathematical analysis shows that circular loops are the best of the common shapes and the triangles are the worst. However, the differences are small.

Although the other advantages of these loops are important, the gain advantage is most significant to this discussion. To illustrate this advantage, FIG. 2 shows the rectangular version of them (201). The wide arrows in this diagram and FIG. 3 represent some aspects of the currents flowing in the conductors. All of these arrows attempt to denote the current patterns as the standing waves vary from each null through the maximum to the following null in each electrical half-wave of the current paths. At the centers of these arrows, the currents would reach the maxima for the paths denoted by these particular arrows. Where the arrowheads or arrow tails face each other, there would be current nulls and the currents immediately on either side of these points would be flowing in opposite directions. However, beside these indications of where the current maxima and minima would be located, not much else is denoted by these arrows. Particularly, one should not assume that the currents at the centers of all the current paths are of equal magnitudes and phases just because all of these currents are denoted as I. In general, the interaction of the currents will produce a complicated amplitude and phase relationship between these currents. Nevertheless, it would be unusual if the phases of these currents were more than 90 degrees away from the phases implied by the directions of the arrows. That is, the phases would not be so different from an implied zero degrees that the arrows should be pointed in the opposite direction because the phases were closer to 180 degrees than to zero degrees.

Of course, these current directions are just the directions of particular currents relative to the directions of other currents. Obviously, they are all alternating currents that change directions according to the frequency of operation.

As indicated by the generator symbol (205) in FIG. 2, if energy were fed into one side of the loop, maxima of current standing waves would be produced at this feeding point and at the center of the opposite side of the loop, because it is a one-wavelength loop. The current minima and voltage maxima would be half-way between these current maxima.

One result of this current distribution is that the radiation is not uniform in the YZ plane (203). This is because there are two conductors carrying the maximum current, the top and bottom of the loop in FIG. 2, which are perpendicular to that plane. Although these two currents are approximately equal in amplitude and phase, because of the symmetry, their fields would add in phase only in the direction of the Y axis. That is because the distances from those two conductors to any point on the Y axis are equal and, therefore, the propagation delays are equal. In other directions, because the distances traveled to any point would be different for the two fields, the fields would not add in phase. The result is that the radiation pattern in that plane is similar in shape to that illustrated by FIG. 1A. Hereinafter, this plane (203) will be called the principal H (magnetic field) plane, as is conventional.

Therefore, this element has gain relative to a half-wave dipole antenna in the direction perpendicular to the plane of the loop, which is the direction of the Y axis in FIGS. 1A, 1B, 1C, and 2. Also because of this nonuniform pattern, if plane 203 were vertical (horizontal polarization), signals transmitted at vertical angles near the horizon would be somewhat stronger. This factor gave this antenna element the reputation for being better if a high supporting tower were not available. Antennas located near the ground usually produce weak signals near the horizon.

This ability to produce stronger signals near the horizon is important in and above the very-high frequencies because signals generally arrive at low vertical angles. Fortunately, it is not difficult to put signals near the horizon at such frequencies because it is the height in terms of wavelengths that matters and, with such short wavelengths, antennas easily can be positioned several wavelengths above the ground. It also is important to put signals near the horizon at high frequencies because long-distance signals arrive at angles near the horizon and they usually are the weaker signals. This is more difficult to achieve, because the longer wavelengths determine that antennas usually are close to the ground in terms of wavelengths.

Another advantage of this kind of antenna element is that it is only one-half as wide as the half-wave dipole antenna and, therefore, it can be placed in smaller spaces. On the other hand, because its high-current paths are shorter than those of a half-wave dipole, it produces a slightly broader radiation pattern in the plane that is perpendicular to both the plane of the antenna (202) and the principal H plane (203). Hereinafter, in this description and the attached claims, this will be called the principal E (electric field) plane (204), as is conventional. This broader E-plane pattern reduces the antenna gain to a relatively small extent. The net effect is that these loops do not have as much an advantage in satellite applications, where sheer gain may be most important, as they have in terrestrial applications, where performance at low elevation angles may be most important.

Prior Art—Pairs of Loops

More significant advances have been made using closely spaced pairs of loops. Examples of them have been disclosed by B. Sykes in *The Short Wave Magazine* of January, 1955, by D. H. Wells in U.S. Pat. No. 3,434,145, and by W. W. Davey in 73 *Magazine* of April, 1979. But mathematical analysis reveals that the best combination so far is John Pegler's pair of triangular loops, with one corner of each loop at the central point, which was disclosed by Patrick Hawker in *Radio Communications* of January, 1969. Mr. Hawker reported that Mr. Pegler had used Yagi-Uda arrays of such elements for "some years" on amateur radio and broadcast television frequencies. Because Mr. Pegler called them "double-delta" antenna elements, hereinafter that name will be used.

Because of the interaction of the fields, these combinations of two loops modify the magnitude and phase of the currents to an extent that makes the combination more than just the sum of two loops. The result is that the dimensions can be chosen so that the field patterns in the principal H plane can be like FIG. 1B or even like FIG. 1C. Such dimensions give not only more gain by narrowing the major lobe of radiation but, particularly in the case of FIG. 1B, the radiation in undesired directions also can be greatly reduced. In addition, some arrays of such two-loop combinations can reduce the radiation to the rear to produce very desirable unidirectional radiation patterns in the principal H plane. On the high-frequency bands, such radiation patterns can reduce the strength of high-angle, short-distance signals being received so that low-angle, long-distance signals can be heard. For receiving weak very-high-frequency or ultra-high-frequency signals bounced off the moon, for another example, such a pattern will reduce the noise being received from the earth or from stars that are not near the direction of the moon. Also, for communications using vertical polarization on earth, so that the principal H plane is horizontal, such radiation patterns would reduce the interference from stations located in horizontal directions different from that of the desired station.

The gain advantage of these triangular loops seems to be based on the need to separate the high-current parts of the element by a relatively large distance. As it is with combinations of Yagi-Uda arrays of dipoles, for example, there is a requirement to separate individual antennas by some minimum distance in order to achieve the maximum gain from the combination. The separation of the high-current parts achieved by the rectangular loops of Sykes and Wells is less than it could be because not only are the outer sides high-current active parts but so also is the central side. Davey's diamonds separate the high-current outer parts to a greater degree, but that shape is not the best available. Triangular loops waste less of the available one-wavelength loop perimeter in placing the outer high-current parts far from the central point. Thanks to the acute angles in the center, triangular loops also greatly reduce the radiation from the central high currents, because those currents are flowing in almost opposite directions into and out of the central corner. Therefore, as far as combinations of two loops approximately one wavelength in perimeter are concerned, these triangles seem to produce the maximum gain available so far.

THE INVENTION

The Invention—Smooth Embodiments

Since this prior art of pairs of triangular loops performs well, it is reasonable to investigate shapes of loops that are somewhat similar to triangles. If the central acute angles were kept, to reduce the radiation from the central high currents, but the outer sides were bowed outward and, perhaps, the outer corners were rounded, the performance would be improved. Particularly, it is possible to increase the directivity of the element while still having the FIG. 1B type of radiation pattern. Pegler's triangles also can produce such directivities, but they are accompanied by minor radiation lobes as in FIG. 1C. That is, with Pegler's triangles, the FIG. 1B type of radiation pattern is available essentially with only one combination of gain and bandwidth. With the present invention, the FIG. 1B type of radiation pattern is available with a variety of combinations of gain and bandwidth. However, with either loop shape, as usual, higher gains are accompanied by smaller bandwidths.

The two loops in FIG. 3, 302 and 303, have such a desirable shape, because they are like bowed outward and rounded triangles that meet at a point in the center. Note that the connection to the associated electronic equipment, represented by the generator symbol, 301, is between one side of both loops and the other side of both loops. This connection produces the current pattern shown in FIG. 3, because the loops have perimeters of one-wavelength.

Hereinafter in this description and the attached claims, the associated electronic equipment will be the type of equipment usually connect to antennas. That equipment would include not only transmitters and receivers for communication, but also such devices as radar equipment and equipment for security purposes. Hereinafter in this description and the attached claims, the distance between the center point and the outer points of the loops will be called the height of the loops. Hereinafter in this description and the attached claims, the maximum dimension perpendicular to the height of the loops will be called the width of the loops.

Figure 4:
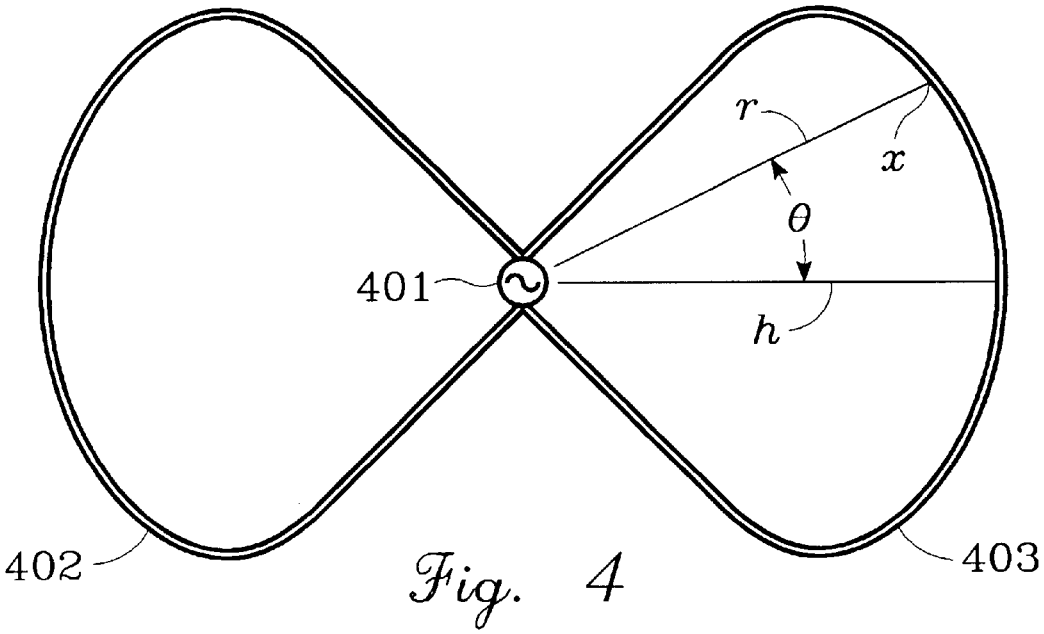
FIG. 4 illustrates the front view of a different embodiment of the invention and illustrates the nature of the mathematical curve.

Although it is probably not necessary, it is convenient for analysis to express the shape of such loops by a mathematical formula. The curve known by mathematicians as a lemniscate serves this purpose very well because, by changing the parameters, it can produce a wide variety of curves that are not only similar to the curve in FIG. 3 but that describe antenna elements that are desirable. As FIG. 4 illustrates, the shape is such that the radius (r) from the. central point to any point (x) on the curve is the height (h), multiplied by the cosine, raised to some power (p), of the angle (θ) between the center line of the loops and a line from the central point to that point (x) on the curve, multiplied by some constant (m). Because the cosine has negative values and negative radii do not make sense, the absolute value is desired. Hereinafter in this description and the attached claims, p will be called the power constant of the curve and m will be called the multiplying constant of the curve.

$$r=h\,|\cos(m\theta)|^{P}$$

where $-\pi/2m<\theta<\pi/2m$ and $(\pi-\pi/2m)<\theta<(\pi+\pi/2m)$

It is necessary to limit the angle to values around zero and π radians because it is possible, with some values of the multiplying constant, to obtain more than two loops from the above expression. Because the purpose of the expression is only to represent the real invention approximately, it is legitimate to limit the expression to whatever adequately represents the invention.

Because the cosine has its maximum value for mθ equaling zero or π, these are the values that will produce the outer points of the curve. In the claims, as is customary, these points will be called the distal points of the element. Also in the claims, the central point will be called the proximal point.

The multiplying constant controls the angle at which the loops approach the center and thereby controls the width of the loops. For example, if the multiplying constant were 2, the cosine would be zero when the angle equaled π/4 radians because mθ would be π/2 radians. Of course, the width influences the resonant frequency because it influences the size of the loops. More obviously, the height also influences the resonant frequency. A less obvious fact is that both the multiplying constant and the height influence the shape of the radiation pattern. Therefore, the task of producing the desired radiation pattern with resonance involves the adjusting of both the multiplying constant and the height. For that task, an antenna analysis program is most desirable.

Figure 5:
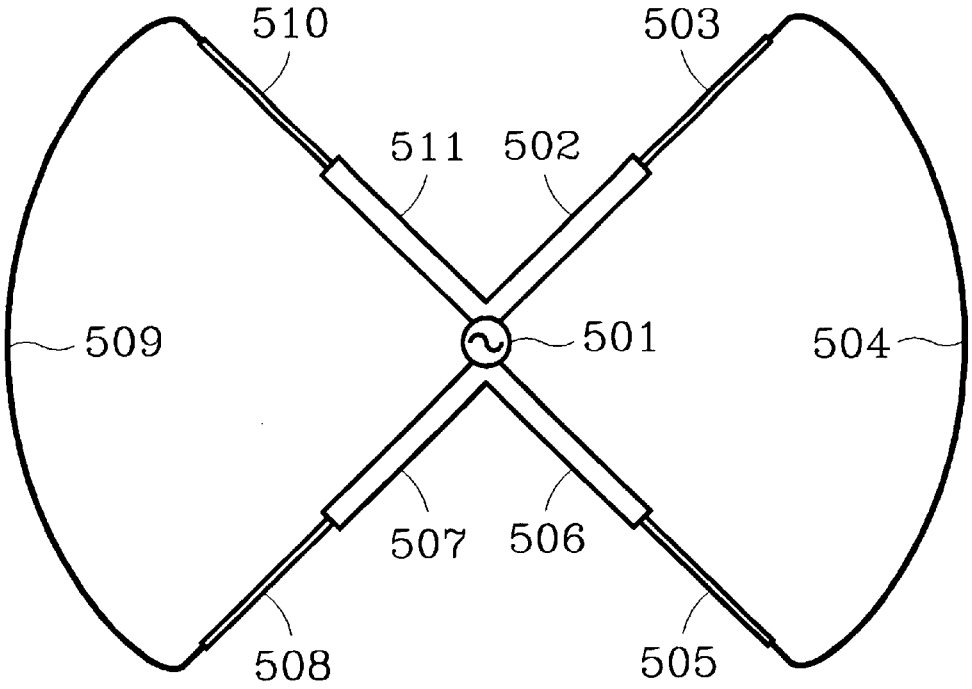
FIG. 5 illustrates the front view of yet another embodiment of the invention and also illustrates that conductors of different types could be used.

The power constant determines the overall shape of the loops. For example, a mathematician would realize that if the power constant equaled one and the multiplying constant were one, the loops would be circles. Because such loops would not approach the central point with the two sides of the loop approximately parallel to each other, thereby reducing the radiation from the central point, such a combination of power constant and multiplying constant would not be an improvement on the prior art. If the power constant were much less than one, the loops would have long straight portions, as in FIGS. 4 and 5. For the power constant equaling 0.1, the loops would be similar to FIG. 4, with parts 401 to 403. FIG. 5, with parts 501 to 511, represents the loops for the power constant equaling 0.02. In the extreme case, for the power constant equaling zero, the loops would be sectors of a circle.

Figure 1B:
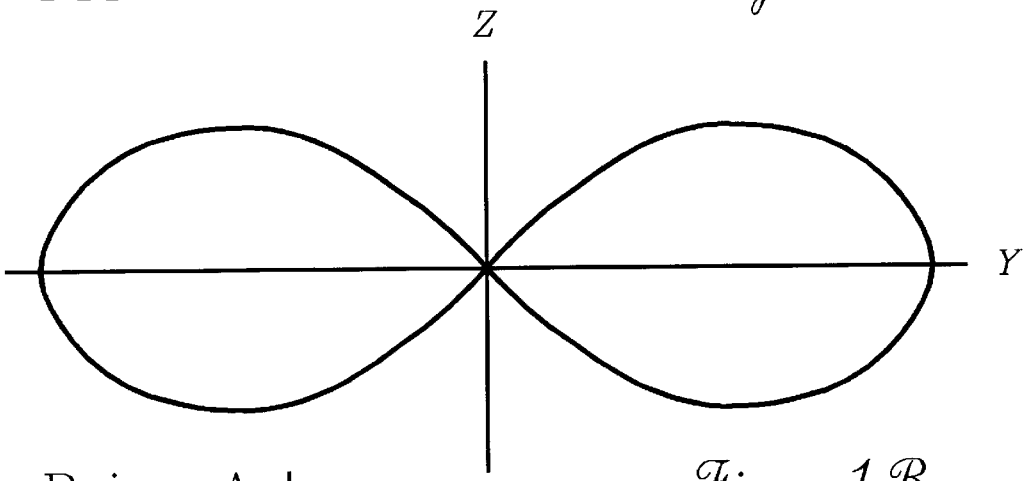
Prior Art Fig. 1B

Since radiation curves similar to FIG. 1B usually are desirable because they suppress radiation in undesired directions, it is worthwhile to consider the results available if only such radiation curves are considered. That is, for various values of the power constant, values of the multiplying constant can be chosen to produce such radiation curves. With such values of the multiplying constant, values of the power constant that are much less than one, as in FIGS. 4 and 5, produce less directivity and more bandwidth than values of the power constant closer to one. Such loop shapes would not only be useful where the bandwidth is important, but the long straight parts would be mechanically convenient for high-frequency antennas because the loops would be large and the conductors must be strong. Because it is inconvenient to bend large conductors, it is convenient to use a design that has approximately straight conductors.

Values of the power constant that are above approximately 0.4 or 0.5, with multiplying constants producing the FIG. 1B type of radiation curve, give modest increases in gain but substantial decreases in bandwidth. This seems to be because the multiplying constants needed to produce the FIG. 1B type of curve, with such power constants, are so close to one that the curve approaches the central point almost from the side. This is undesirable because the radiation from the central currents will not cancel each other very well. Therefore, it is expected that such values of the power constant would be used less often.

Figure 1C:
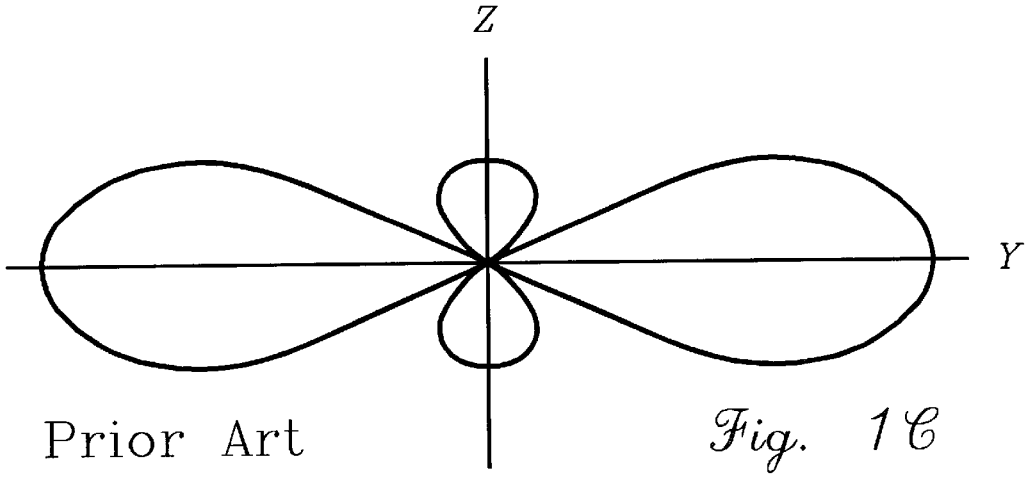
Prior Art Fig. 1C

If gain were more important than bandwidth or than the suppression of minor lobes of radiation, values of the power constant and multiplying constant could be chosen to produce the FIG. 1C type of curve with significant increases in gain. For example, in parts of the very-high and ultra-high frequency amateur-radio bands, narrow modes of operation, such as single-sideband, are used in relatively narrow parts of the bands with horizontal polarization. In such cases, the minor lobes in the principal H plane would be in the vertical plane and usually would not be significant. A narrow band antenna with a power constant and a multiplying constant chosen to produce a high gain but with a narrow bandwidth and significant minor radiation lobes might be preferred. Values of the power constant as high as 2 or 3 may be considered desirable for such antennas. In the remainder of such bands, where vertical polarization is used over a wide bandwidth, so that the principal H plane would be the horizontal plane, values of the power constant and multiplying constant to produce a wide bandwidth and hardly any minor lobes of radiation to receive undesired stations probably would be preferred.

The Invention—Angular Embodiments

Figure 6:
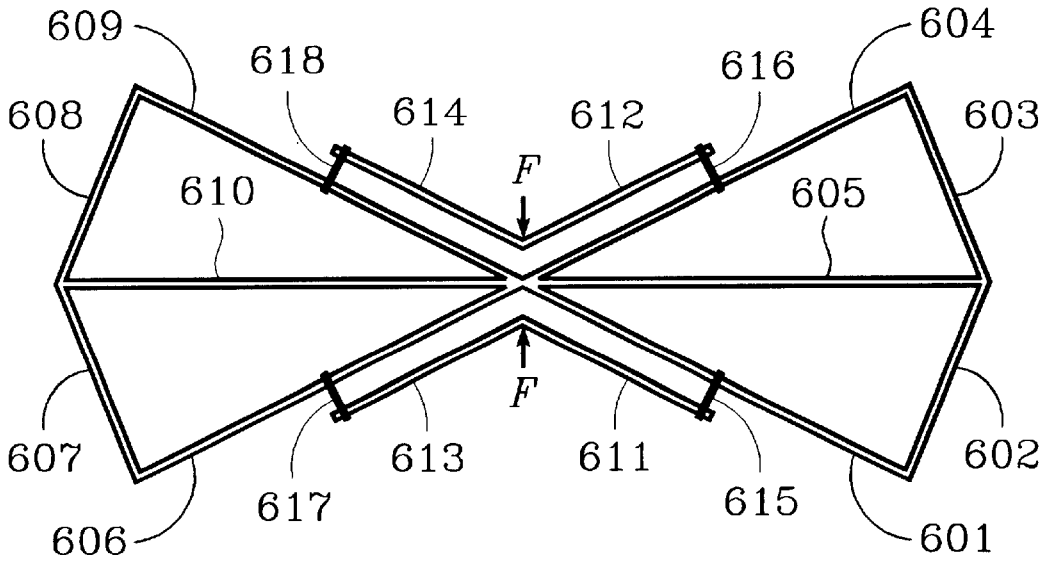
FIG. 6 illustrates the front view of yet another embodiment of the invention, using straight conductors for the loops and using central strengthening conductors.

As was stated above, the use of the lemniscate cosine curve is an analysis convenience, not a definite requirement. If the shape of the loop were substantially the same as a lemniscate curve, the results should be substantially the same. FIG. 6, with parts 601 to 618 illustrates such a shape. If the straight parts 602, 603, 607, and 608, adequately simulated parts of a circle, the loops formed by parts 601 to 604 and parts 606 to 609 would perform substantially the same as the sectors of a circle produced by the power constant equaling zero.

One also should note that although this structure appears superficially similar to a conical dipole, such as the one in Henry White's U.S. Pat. No. 2,615,005, the method of connecting it to the transmission line is radically different. The conical dipole is fed between one loop and the other loop. The lemniscate antenna element, and the other double-loop elements mentioned above, are fed between one side of both loops and the other side of both loops. This changes the current distribution and, therefore, the nature of the antennas.

The Invention—Construction Tactics

Figure 7:
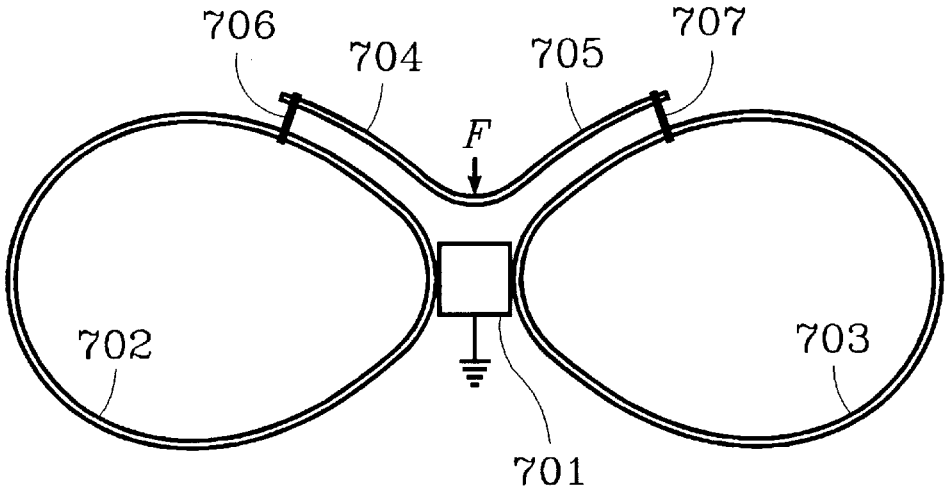
FIG. 7 illustrates the front view of a lemniscate antenna element attached to the supporting boom in a different manner and also illustrates the double-gamma matching system.
Figure 8:
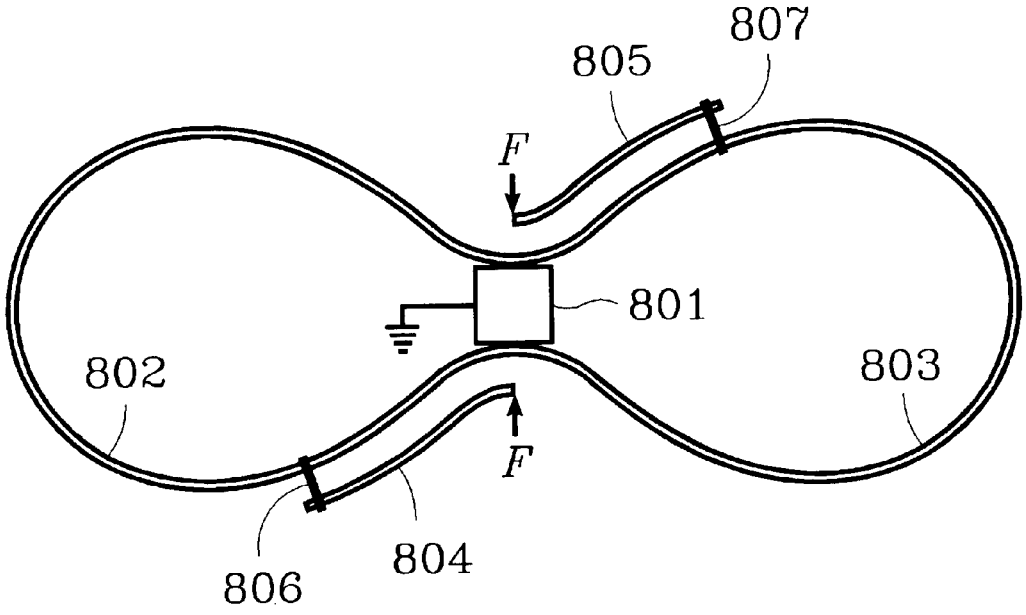
FIG. 8 illustrates the front view of a lemniscate antenna element attached to the supporting boom in yet a different manner and also illustrates the staggered-gamma matching system.

FIG. 7, with parts 701 to 707, and FIG. 8, with parts 801 and 807, illustrate two more deviations from the strict lemniscate shape. If the boom holding the antenna elements were rectangular, as are parts 701 and 801, it might be convenient to attach the loops to the sides of the boom. If this produced loop shapes that were substantially the same as the lemniscate shape, there should be no substantial difference in performance. However, it appears that the antenna element of FIG. 7 tends to produce significantly less bandwidth with only a small increase in gain relative to the antenna elements of FIGS. 3 and 8.

FIG. 5 also illustrates some choices in construction materials. If the antenna element were large, the parts near the central point of support, such as parts 502, 506, 507, and 511, would have large cross-sectional areas because they must support themselves and the parts further from the point of support. At the outer ends of the element, parts 504 and 509 would have smaller cross-sectional areas because they are required to support only themselves. Between these extremes, parts 503, 505, 508, and 510 would have cross-sectional areas between the areas of the other parts. In addition, it would be expected that the larger parts would be tubing to reduce the weight and cost, and the smaller parts, like 504 and 509, would be solid rods, because rods are less expensive than tubes in small sizes.

There are many conventional and acceptable means of connecting the various parts of lemniscate antenna elements. For example, they could be bolted, held by various kinds of clamps, or soldered, brazed or welded with or without pipe fittings at the joints. As long as the effect of the means of connection upon the effective length of the parts is taken into account, there seems to be no conventional means of connecting antenna parts that would not be acceptable for lemniscate antenna elements.

However, before the final dimensions have been obtained, it is convenient to have the means to make adjustments to the length of the conductors. Often a computer-aided design will produce reasonably correct loop heights and reasonably correct distances between the various lemniscate antenna elements in an array. Therefore, adjusting only the widths of the loops on the antenna range may be an acceptable tactic to produce a final design. The shape that is a sector of a circle, similar to the shape in FIG. 5, is convenient for this tactic, because it has circular parts like 504 and 509. If the clamps connecting these circular parts to the rest of the loops allowed changes in the lengths of these circular parts, the widths of the loops could be changed without changing the alignment of the high-current parts of the array.

Because the conductors of these loops are typically curved, it would be mechanically convenient to use rectangular conductors. However, it must be remembered that radio frequency currents flow in the parts of conductors that are furthest from the center. That is, the currents would flow, essentially, in the outer edges of the conductors. For rectangular conductors, the currents would flow substantially in the corners of the conductors. If the conductors were very thin, like sheet metal conductors, the area through which the current would flow would be small and the resistance would be relatively high. For a dipole, this could be a significant problem, because the radiation resistance of dipole arrays can be rather low. That is, too much power may be dissipated in the conductors relative to the power that is radiated. Fortunately, the radiation resistances of loops usually are larger than the radiation resistances of dipoles, so that this efficiency problem is less severe for most lemniscate antenna elements. Nevertheless, rectangular conductors produce a mechanical convenience with a possible electrical disadvantage.

The Invention—Strengthening Conductors

In FIG. 6, parts 605 and 610 illustrate additional strengthening parts, which could be desirable if the antenna element were large. Hereinafter, lemniscate antenna elements having these additional strengthening parts will be called strengthened lemniscate antenna elements. Such strengthened elements would be particularly desirable for the turnstile and log-periodic arrays of lemniscate antenna elements. However, it must be suspected that a conductor placed across the loop would change the nature of the antenna element. That is not true in this particular case for the following reasons.

If the center of the antenna element were at ground potential and the antenna element were connected to the associated electronic equipment in a balanced manner, which is desirable anyway, the voltages at points on parts 601 and 602 would be equal to and of opposite polarities to the voltages at corresponding points on parts 604 and 603. These voltages would be equal because the loops are symmetrical and the corresponding points would be at equal distances from the central, grounded point. They would be of opposite polarities because no currents would flow around the loops if these voltages were of the same polarities. At the outer ends of the loops, where parts 602 and 603 are connected, the voltage must be of equal magnitude and of opposite polarity to itself The only voltage that satisfies those criteria is zero volts. That is, that point is at ground potential. Therefore if a conductor, such as part 605, were connected between the central point and the junction of parts 602 and 603, no current would flow in part 605 because of that connection, because the two ends of that additional conductor would be at ground potential.

The other way that a current could be in part 605 is by radiation. Referring to FIG. 3, it can be observed that the currents on the loop on the two sides of part 605 would be flowing in opposite directions. That is, whatever voltages would be induced in part 605 by the currents in parts 601 and 602 would be cancelled by the voltages induced by the currents in parts 604 and 603. Therefore, no currents would flow in part 605 either by the connection to the loops or by voltages induced by the currents in the loop. That is, the addition of part 605 would not change the operation of the loop if the loop were perfectly balanced. Fortunately, it would be difficult to detect the change if the balance were good but not perfect. That would not be true if part 605 were connected between two other points on the loop.

The Invention—Matching Tactics

Because it is unlikely that the impedance of an antenna element will equal the impedance of the transmission line leading to the associated electronic equipment, some kind of matching system usually is required. To match a balanced antenna element, a T match is a traditional choice. Because the lemniscate antenna element has two loops, two T matches are appropriate. FIG. 6 shows such a system with T parts 611 to 614 and the shorting parts 615 to 618. The transmission line typically would be connected at the feeding points, F, through tuning capacitors and, if the transmission line were unbalanced, through some kind of balanced-to-unbalanced transformer. Except for the fact that there are two loops, these are all conventional tactics for connecting a transmission line to a balanced antenna element. Because they are conventional and, therefore, they would unnecessarily complicate the diagram, the capacitors and transformer were omitted from the diagram.

Some designers have connected to double-loop antenna elements on only one side of the loops, as in FIG. 7. This might be called a double gamma match, with gamma conductors 704 and 705, plus shorting conductors 706 and 707. Usually, only a tuning capacitor is connected between point F and an unbalanced transmission line. The rational for this tactic seems to be based on the thought that the central point, which is at the square boom 701 in this diagram, necessarily would be at ground potential if it were connected to ground by the tower or mast. This is, of course, not true at radio frequencies. If there were currents in the tower, part 701 could be at ground potential or far above ground potential depending on whether the standing waves on the tower produced a voltage null at part 701 or some other voltage. In order to be certain that the central point would be at ground potential, the matching system must not upset the balance and produce currents to ground via the boom, mast, and tower. Otherwise, the currents in the tower, etc. may produce significant minor radiation lobes. Also, with an unbalanced coaxial transmission line, there may be currents on the outside conductor of the transmission line that can raise the covers of the associated electronic equipment above ground potential.

A better tactic is illustrated by FIG. 8. This might be called a staggered double gamma match, with gamma conductors 804 and 805 and shorting conductors 806 and 807. The tuning capacitors and balanced-to-unbalanced transformer would be connected to points F, as in the case of double T match. This tactic works because the boom is halfway between the two balanced feeding points by the two equal paths around the loops. It works, that is, in free space. If the antenna element were significantly close to ground, the impedances of the two loops would not be equal, because of the significantly different distances to ground and, therefore, because of the different mutual impedances acting on them. If the antenna element were several wavelengths above ground, the absolute sizes and the differences in the mutual impedances would be small. Only in such a case, which would occur at very-high and ultra-high frequencies, would this tactic be preferred because of the reduction in weight and cost.

The Invention—The Double Loop Embodiment

For some applications, a variation of this basic lemniscate antenna element can be beneficial. When antenna parts are close to each other or when antennas are close to the ground, in terms of wavelengths, the terminal impedances can be rather low. This might produce a problem of efficiency if the loss resistance of the parts became significant relative to the resistance that represented the antenna's radiation. To raise the impedance, one tactic is to use multiturn loops, as in Moore's patent.

Figure 9:
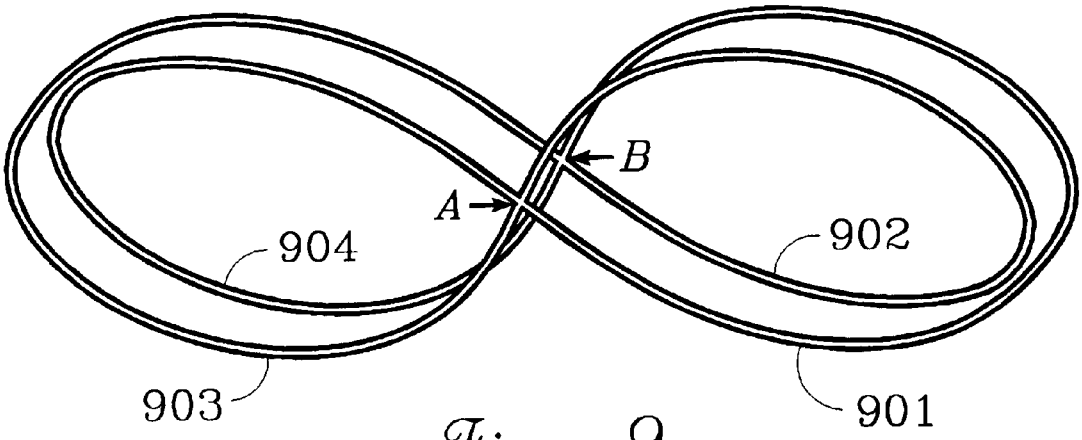
FIG. 9 illustrates a perspective view of a lemniscate antenna element formed by two pairs of loops.

FIG. 9 shows the equivalent embodiment of lemniscate antenna elements. Hereinafter, this element will be called a double-loop lemniscate antenna element. The tactic is to replace the single current paths around the loops with paths that allow the currents to travel around the loops twice. In FIG. 9, one current path is from point A, around part 901 to point B, and then around part 902 back to point A. The other current path is from point A, around part 903 to point B, and then around part 904 back to point A. Either point A or point B could be connected to the associated electronic equipment. If the connection were made in a balanced manner (such as to point A), the other point (such as point B) would be at ground potential, because the distances between these two points around the loops are equal. The feeding system was not shown on this diagram, because it would be conventional and it would unnecessarily confuse the diagram.

Depending on the dimensions, this tactic can significantly raise the terminal impedance. As it is with dipoles, this tactic also can produce wider bandwidths. It is instructive to consider the two loops to be similar to two coupled resonant circuits, like a tuned transformer. That is, the mutual impedance from the secondary resonant circuit can produce three resonances in the primary resonant circuit, and thereby widen the bandwidth. Of course, as it is with dipoles, more than two current paths around the loops could be used.

When the two lemniscate antenna elements are close to each other, there is a slight difference in the radiation in the two directions perpendicular to the planes of the conductors. If the spacing were larger, the difference would be larger. Usually, this difference would be minimized by a close spacing, but sometimes the difference may be useful. If only one double-loop lemniscate antenna element could be used, perhaps because it were large, using a wider spacing might be a convenient tactic to get a somewhat unidirectional radiation pattern.

One limitation of double-loop lemniscate antenna elements is that strengthening parts cannot be used as they are in FIG. 6. Points A and B can be at ground potential, but there is no reason to believe that the outer points of the loops in FIG. 9 are at ground potential because, unlike the outer points of single loops, they are not equidistant from the two sides of the balanced feeding point. Therefore, there is no justification for directly connecting these outer points to the central points with strengthening conductors.

APPLICATIONS

Applications—Turnstile Arrays

Figure 10:
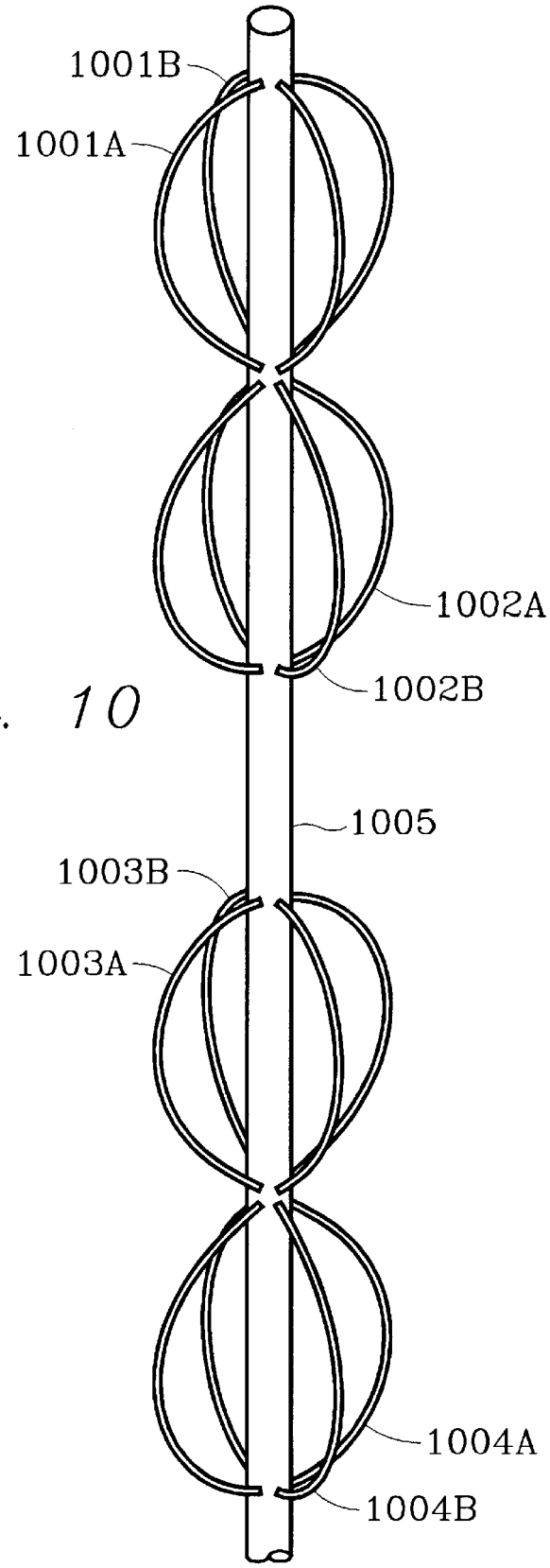
FIG. 10 illustrates a perspective view of two turnstile arrays of lemniscate antenna elements.

These lemniscate antenna elements may be used in the ways that other antenna elements are used. That is, they may be combined with other lemniscate antenna elements to produce larger arrays. For broadcasting or for networks of stations, a horizontally-polarized radiation pattern is often needed that is omnidirectional instead of unidirectional in the horizontal plane. To achieve this, an old antenna called a turnstile array sometimes has been used. It comprises two half-wave dipole antennas oriented at right angles to each other and fed 90 degrees out of phase with each other. FIG. 10 shows the equivalent arrangement of lemniscate antenna elements that would serve the same purpose. Hereinafter, this arrangement will be called a turnstile array of lemniscate antenna elements.

In FIG. 10, there are two such arrays. Parts 1001A and 1002A form one lemniscate antenna element for the top array and parts 1001B and 1002B form the other lemniscate antenna element for the top array. In the bottom array, parts 1003A and 1004A form one element and parts 1003B and 1004B form the other element. Conventional matching and phasing systems for turnstile arrays could be used, so they are not shown in FIG. 10 to avoid unnecessary confusion in the diagram.

Such an array would produce more gain in the H radiation pattern, which usually would be the vertical radiation pattern, than a similar array of dipoles or double-delta antenna elements. That is, if it were necessary to have several turnstile arrays stacked vertically for increased gain, the stack of turnstile arrays of lemniscate antenna elements would require fewer feed points for the same amount of gain.

As was explained above, if a lemniscate antenna element were connected to the associated electronic equipment in a balanced manner, the outer points of the loops would be at ground potential. Therefore, as shown in FIG. 10, turnstile arrays of lemniscate antenna elements can be connected to a conducting mast (1005) at the center and at the outer points of the loops to produce a rugged antenna.

Of course, turnstile arrays could be made with three or more lemniscate antennas elements, spaced physically and electrically by less than 90 degrees. For example, three elements could be spaced by 60 degrees. Such arrays may produce a radiation pattern that is closer to being perfectly omnidirectional, but such an attempt at perfection would seldom be necessary. More useful might be two elements spaced physically and electrically by angles that may or may not be 90 degrees, with equal or unequal energy applied. Such an array could produce a somewhat directive pattern, which might be useful if coverage were needed more in some directions than in other directions.

Applications—Broadside and Collinear Arrays

Another application of lemniscate antenna elements arises from observing that half-wave dipoles traditionally have been positioned in the same plane either end-to-end (collinear array), side-by-side (broadside array), or in a combination of those two arrangements. Often, a second set of such dipoles, called reflectors or directors, is put into a plane parallel to the first plane, with the dimensions chosen to produce a somewhat unidirectional pattern of radiation. Sometimes an antenna element is placed in front of a reflecting screen (1111), as in FIG. 11. Such arrays have been used on the high-frequency bands by short-wave broadcast stations, on very-high-frequency bands for television broadcast reception, and by radio amateurs.

Hereinafter in this description and the attached claims, the front end of an antenna will be the end pointing in the direction of the desired radiation. The rear end of an antenna will be the end opposite from the front end.

Figure 11:
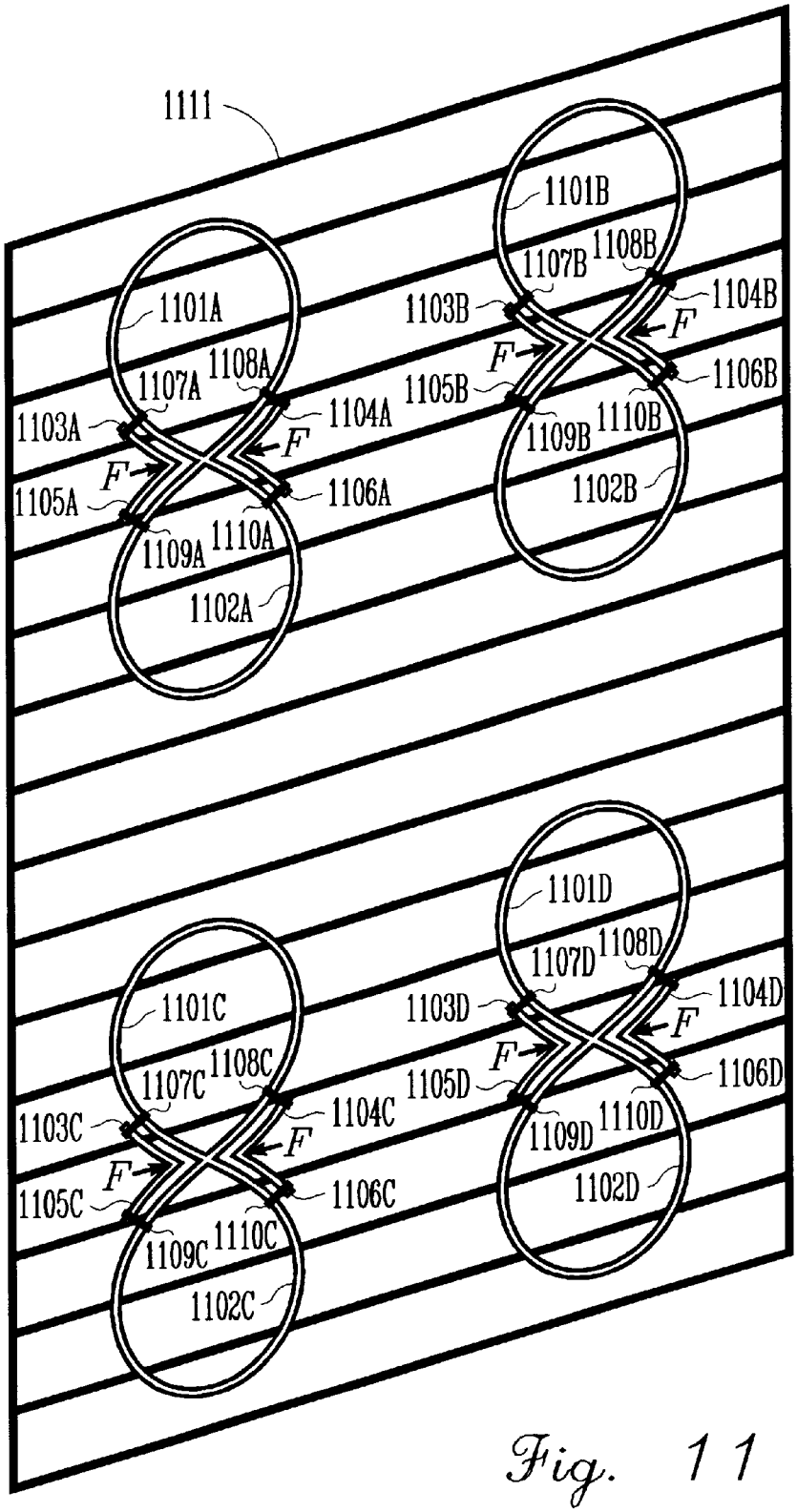
FIG. 11 illustrates a perspective view of four lemniscate antenna elements positioned in front of a reflecting screen.

The same tactics can be used with lemniscate elements, as FIG. 11 shows. However, the definitions of what constitutes a collinear array or broadside array of dipoles does not serve the purpose with curved elements like lemniscate antenna elements. For example, what would be an end-to-end alignment if there were no ends? Instead, it is a more universal definition to specify the alignments in terms of the E and H fields. In those terms, a collinear array would have the elements aligned in the direction of the E field. Likewise, the broadside array could be defined as having the elements aligned in the direction of the H field.

By these definitions, it is apparent that the element having parts 1101A to 1110A is in a collinear arrangement with the element having parts 1101B to 1110B, because they are aligned in the direction of their E fields. The element having parts 1101C to 1110C and the element having parts 1101D to 1110D are similarly aligned. The A element is in a broadside arrangement with the C element, because they are aligned in the direction of their H fields. The B element and the D element are similarly aligned.

Perhaps the main advantage of using lemniscate antenna elements rather than dipoles in such arrays is the less complicated system of feeding the array for a particular overall array size. That is, each lemniscate antenna element would perform in such an array as well as two or more half-wave dipoles.

Sometimes collinear or broadside arrays of dipoles have used unequal distributions of energy between the dipoles to reduce the radiation in undesired directions. Since lemniscate antenna elements reduce such undesired radiation anyway, there would be less need to use unequal energy distributions in equivalent arrays to achieve the same kind of result. Nevertheless, if such an unequal energy distribution were used, it should be less complicated to implement because of the less complicated feeding system.

Application—Nonlinear Polarization

Yet another application of lemniscate antenna elements concerns nonlinear polarization. For communications with satellites or for communications on earth through the ionosphere, the polarization of the signal may be elliptical. In such cases, it may be advantageous to have both vertically polarized and horizontally polarized antennas. They may be connected together to produce a circularly polarized antenna, or they may be connected separately to the associated electronic equipment for a polarity diversity system. Also, they may be positioned at approximately the same place or they may be separated to produce both polarity. diversity and space diversity.

Figure 12:
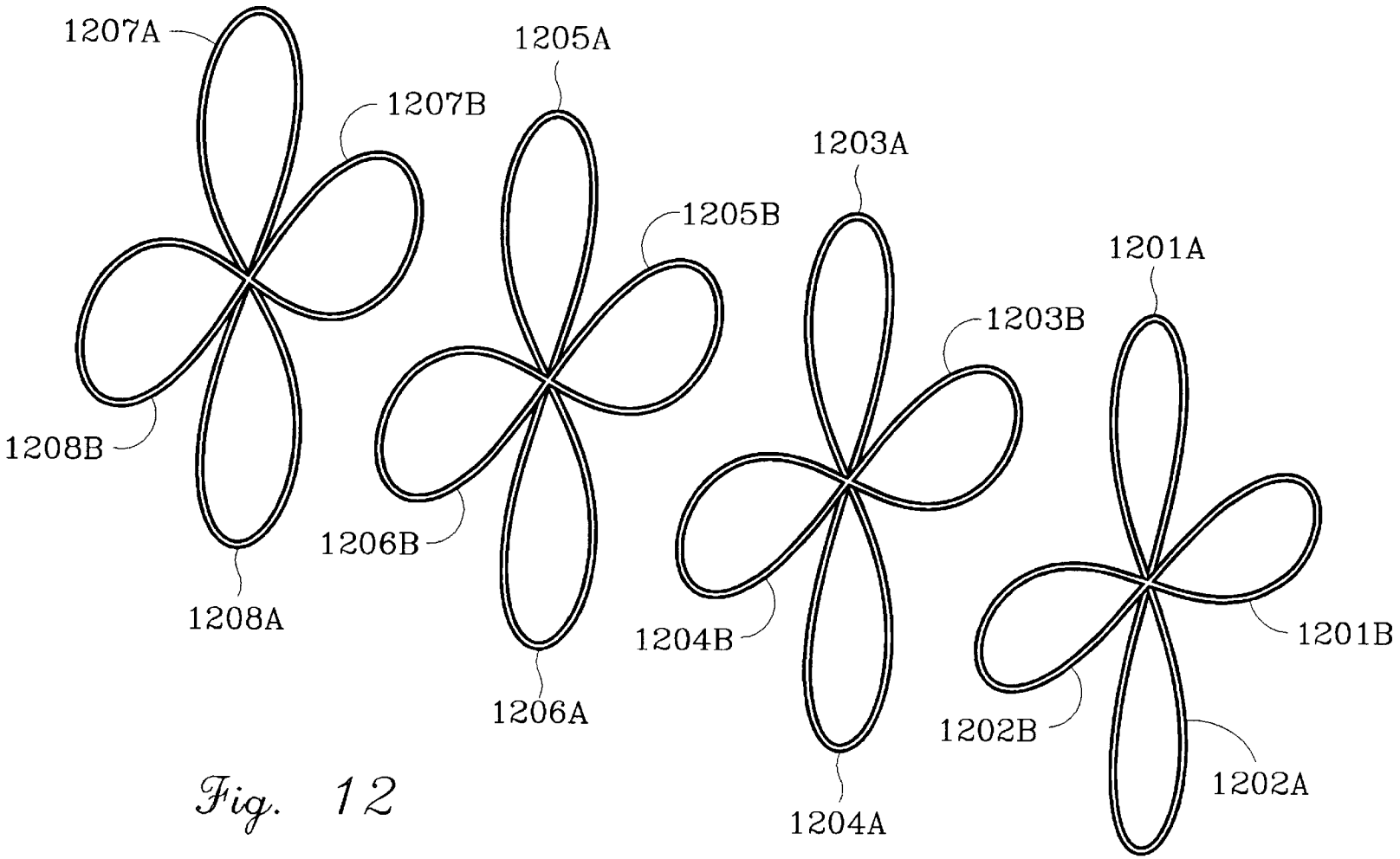
FIG. 12 illustrates a perspective view of an end-fire array of four pairs of lemniscate antenna elements positioned to produce elliptically polarized waves.

FIG. 12 illustrates an array of lemniscate antenna elements for achieving this kind of performance. Parts 1201A to 1208A form a horizontally polarized array and parts 1201B to 1208B form a vertically polarized array. If the corresponding lemniscate antenna elements of the two arrays were approximately at the same positions along the supporting boom, as in FIG. 12, the phase relationship between equivalent parts in the two arrays usually would be about 90 degrees for approximately circular polarization. If the corresponding lemniscate antenna elements of the two arrays were not in the same position on the boom, as is common with similar half-wave dipole arrays, some other phase relationship could be used because the difference in position plus the difference in phase could produce the 90 degrees for circular polarization. It is common with equivalent half-wave dipole arrays to choose the positions on the boom such that the two arrays can be fed in phase and still achieve circular polarization.

However, one should not assume that this choice of position on the boom and phasing does not make a difference in the radiation produced. If two half-wave dipoles were positioned at the same place and were phased 90 degrees, there would tend to be a maximum of one polarity toward the front and a maximum of the other polarity toward the rear. For example, there might be a maximum of right-hand circularly polarized radiation to the front and a maximum of left-hand circularly polarized radiation to the rear. In the same example, there would be a null, ideally, of left-hand radiation to the front and a null of right-hand radiation to the rear. An equivalent array that produces the phase difference entirely by having the two dipoles in different positions on the boom would perform differently. Depending on how it was connected, it could have maxima of left-hand radiation to the front and rear. In such a case, the right-hand radiation would have maxima to the side and minima to the front and rear.

Of course, such arrays of individual dipoles would perform differently from such arrays of lemniscate antenna elements. Also, if these elements were put into larger arrays, the patterns would change some more. Nevertheless, one should not assume that the choice of using phasing or positions on the boom to achieve circular polarization does not change the antenna performance. One must make the choice considering what kind of performance is desired for the particular application.

Although this arrangement of elements usually is chosen to produce circularly polarized radiation, one also should note that a phase difference of zero degrees or 180 degrees will produce linear polarization. As the array is shown in FIG. 12, those linear polarizations would be at 45-degree angles to the earth, which probably would not be desired. It probably would be more desirable to rotate the array around the direction of the axes of the loops by 45 degrees to produce vertical or horizontal polarization. With such an array, it would be possible to choose vertical polarization, horizontal polarization, or either one of the two circular polarizations by switching the amount of phase difference applied to the system. Such a system may be very useful to radio amateurs who use vertical polarization for frequency modulation, horizontal polarization for single sideband and Morse code, and circular polarization for satellite communication on very-high-frequency and ultra-high-frequency bands. It also could be useful on the high-frequency bands because received signals can have various polarizations.

Applications—Yagi-Uda Arrays

Yet another application, commonly called an end-fire array, has several lemniscate antenna elements positioned so that they are in parallel planes and the central points and outer points of the loops are all aligned in the direction perpendicular to those planes. One lemniscate antenna element, some of them, or all of them could be connected to the associated electronic equipment. If the second lemniscate antenna element from the rear were so connected, as in FIG. 13, and the dimensions produced the best performance toward the front, it could logically be called a Yagi-Uda array of lemniscate antenna elements. Hereinafter, that name will be used for such arrays.

Figure 13:
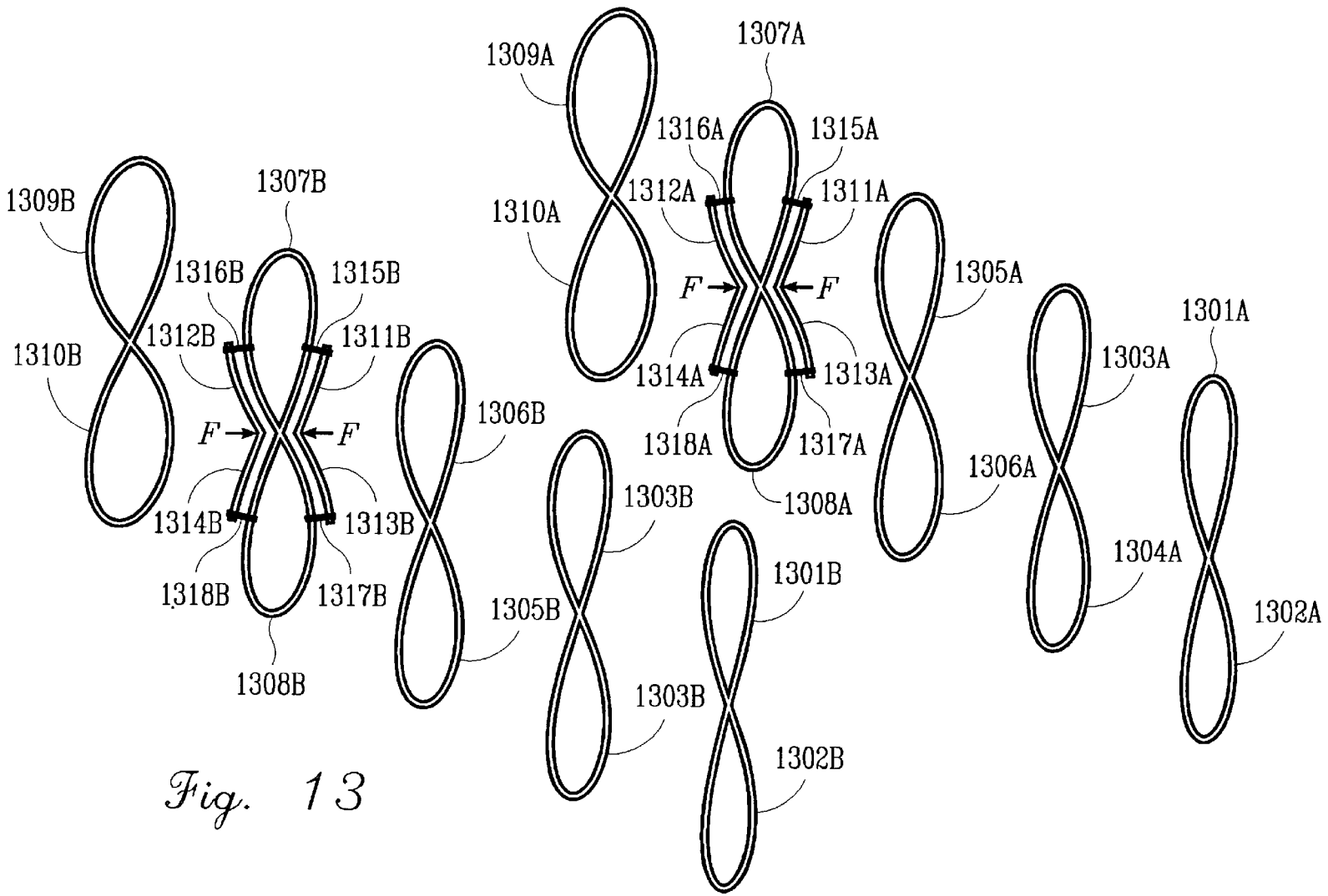
FIG. 13 illustrates a perspective view of two Yagi-Uda arrays of lemniscate antenna elements pointed in the same direction.

FIG. 13 illustrates two such Yagi-Uda arrays in a collinear arrangement: parts 1301A to 1318A forming one of them and parts 1301B to 1318B forming the other one. Hereinafter, the lemniscate antenna elements that are connected to the associated electronic equipment by the T matching systems, 1311A to 1318A or 1311B to 1318B, will be called the driven elements. The elements to the rear with parts 1309A and 1310A or parts 1309B and 1310B will be called the reflector elements. The remaining elements will be called the director elements. This terminology is consistent with the traditional names for dipoles in Yagi-Uda arrays. Another possible, but less popular, array would have just two such elements with the rear one connected, called the driven element, and the front one not connected, called the director element.

The tactic for designing a Yagi-Uda array is to employ empirical methods rather than equations. This is partly because there are many combinations of dimensions that would be satisfactory for a particular application. Fortunately, there are computer programs available that can refine designs when reasonable trial designs are presented to the programs. That is as true of arrays of lemniscate antenna elements as it is for dipole arrays. To provide a trial design, it is common to make the driven element resonant near the operating frequency, the reflector element resonant at a lower frequency, and the director elements resonant at progressively higher frequencies from the rear to the front. Then the computer program can find the best dimensions near to the trial dimensions.

The use of lemniscate antenna elements in such an array, instead of dipoles, differs in two respects. Since the radiation pattern in the principal H plane can be changed, that is something to choose. A pattern like that of FIG. 1B may be chosen to suppress the radiation in undesired directions. Also, as stated above, the lemniscate antenna element allows greater flexibility compared to the double delta antenna element, because the FIG. 1B type of pattern can be obtained with a variety of combinations of gain and bandwidth. The second difference is that for arrays that have lemniscate antenna elements aligned from the front to the rear, one should remember that the principal radiating parts, the outer ends of the loops, preferably should be aligned to point in the direction of the desired radiation, perpendicular to the planes of the individual elements. That is somewhat important in order to achieve the maximum gain, but it is more important in order to suppress the radiation in undesired directions. Therefore, when the resonant frequencies of the elements must be unequal, the widths of the loops should be chosen so that the heights of the loops are equal. That is, the heights of the loops preferably should be chosen to get the desired pattern in the principal H plane, and the widths should be changed to achieve the other goals, such as the desired gain.

The kind of lemniscate curve that has a value of power constant equaling zero is particularly convenient for such alignments. Because this curve is a sector of a circle, the whole of the outer parts of the curves would be aligned if the outer points of the curves were aligned, no matter what the multiplying constants were. Therefore, one would expect better performance in suppressing the minor lobes of radiation with such curves. Other lemniscate curves would have different curvatures with the same power constant if the values of the multiplying constants were unequal. Perhaps it is apparent that in FIG. 13, although the outer points of the curves are aligned, away from those points, the curves of part 1301A are not aligned with the curves of part 1309A.

Applications—All-Driven Arrays

Figure 14:
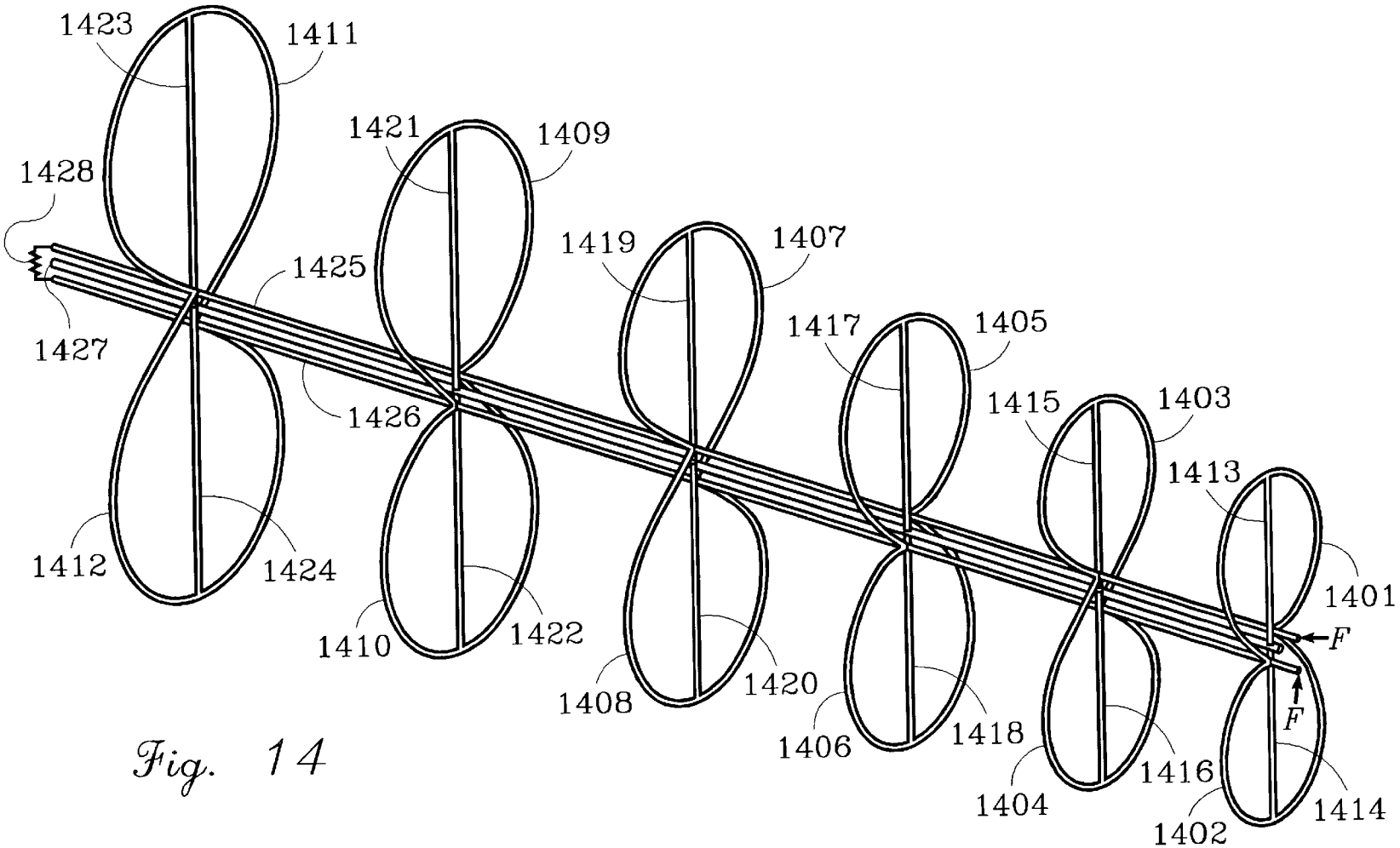
FIG. 14 illustrates a log-periodic array of lemniscate antenna elements.

There are several possibilities for all-driven end-fire arrays but, in general, the mutual impedances make such designs rather challenging and the bandwidths can be very small. The log-periodic array, as illustrated by FIG. 14, is a notable exception. A smaller, feasible all-driven array would be just two identical lemniscate antenna elements that are fed 180 degrees out of phase with each other. The distance between the elements would not be critical, but one-eighth of a wavelength would be a reasonable value. This would be similar to the dipole array described by John D. Kraus in *Radio* of March, 1937, which is commonly called a W8JK array, after his amateur-radio call letters. Since the impedances of the two elements are equal when the phase difference is 180 degrees, it is relatively easy to achieve an acceptable bidirectional antenna by applying such tactics. If a balanced transmission line were used, the conductors going to one element would be simply transposed. For coaxial cable, the use of an extra electrical half wavelength of cable going to one element might be a better tactic to provide the desired phase reversal. If the space were available, such a bidirectional array of lemniscate antenna elements could be very desirable in the lower part of the high-frequency spectrum where rotating such large antennas may not be practicable.

Another possibility is two elements spaced and connected so that the radiation in one direction is almost canceled. An apparent possibility is a distance between the elements of a quarter wavelength and a 90-degree phase difference in their connection. Other distances and phase differences to achieve unidirectional radiation will produce more or less gain, as they will with half-wave dipoles.

Applications—Log-Periodic Arrays

The log-periodic array of lemniscate antenna elements is similar in principle to the log-periodic dipole antenna disclosed by Isbell in his U.S. Pat. No. 3,210,767. Hereinafter, that combination will be called a lemniscate log-periodic array. Log-periodic arrays of half-wave dipoles are used in wide-band applications for military and amateur radio purposes, and for the reception of television broadcasting. The merit of such arrays is a relatively consent impedance at the terminals and a reasonable radiation pattern across the design frequency range. However, this is obtained at the expense of gain. That is, their gain is poor compared to narrow band arrays of similar lengths. Although one would expect that gain must be traded for bandwidth in any antenna, it is nevertheless disappointing to learn of the low gain of such relatively large arrays.

If one observed the radiation pattern of a typical log-periodic dipole array in the principal E plane, it would appear to be a reasonable pattern of an antenna of reasonable gain, because the major lobe of radiation would be reasonably narrow. However, the principal H plane would show a considerably wide major lobe that would indicate poor gain. Of course, this poor performance in the principal H plane is caused by the use of half-wave dipoles. Because half-wave dipoles have circular radiation patterns in the principal H plane, they do not help the array to produce a narrow major lobe of radiation in that plane.

The lemniscate antenna elements are well suited to improve the log-periodic array because they can be designed to suppress the radiation 90 degrees away from the center of the major lobe, as in FIG. 1B. That is, for a horizontally polarized log-periodic array, as in FIG. 14, the radiation upward and downward is suppressed. However, since the overall array of parts 1401 to 1428 has lemniscate antenna elements of various sizes, several of which are used at any particular frequency, it is overly optimistic to expect that the radiation from the array in those directions will be suppressed as well as it can be from a single lemniscate antenna element operating at one particular frequency. Nevertheless, the reduction of radiation in those directions and, consequently, the improvement in the gain can be significant.

A difficulty with traditional log-periodic arrays is that the conductors that are feeding the various elements in the array also are supporting those elements physically. In FIG. 14, they are parts 1425 and 1426. Hereinafter in this description and the attached claims, those conductors will be called the feeder conductors. Those traditional arrays require, first of all, that the feeders must not be grounded. Therefore, the feeder conductors must be connected to the supporting mast by insulators. Not only is this undesirable because insulators usually are weaker than metals, but it also is undesirable because it would be preferable to have a grounded antenna for lightning protection. Another difficulty is that the characteristic impedance between the feeder conductors should be rather high for proper operation. Because the impedance depends on the ratio of the spacing to the conductor diameter, the large size of the feeder conductors needed for mechanical considerations requires a wide spacing between these conductors to obtain the desired impedance. That, consequently, requires supporting insulators between the feeder conductors that are longer than would be desired.

The common method of constructing log-periodic arrays is to support the antenna elements by insulators connected to the grounded boom instead of using strong feeder conductors. Then the connections between the elements are made with a pair of wires that cross each other between adjacent elements. Not only is such a system undesirable because the elements are supported by insulators, but also it is undesirable because the feeder conductors do not have a constant characteristic impedance. Nevertheless, many people seem to be satisfied with this compromise.

Because strengthened lemniscate antenna elements are supported by metal conductors (1413, 1415, 1417, 1419, 1421, and 1423) that are attached with metal clamps to the grounded boom (1427), they offer particular benefits in log-periodic arrays. Since the loops are supporting only themselves, their conductors can be relatively small in cross-sectional area. Likewise, since the feeder conductors are merely attached to the loops, rather than supporting them, the feeder conductors can be small in cross-sectional area. Therefore, there is less need for wide spaces between the boom and the feeder conductors to achieve the required characteristic impedance. This reduces the length of the insulators holding the feeder conductors and reduces the strength required in those insulators. In addition, the whole array can be grounded through the boom, mast and tower. Therefore, much of the mechanical problems of log-periodic arrays are solved by the use of supporting conductors.

As stated above, arrays that have lemniscate antenna elements aligned from the front to the rear, preferably should have their central and outer points aligned to point in the direction of the desired radiation, perpendicular to the planes of the individual elements. That is, the heights of the loops should be equal. That equal-height alignment usually is not a problem with Yagi-Uda arrays. This is partly because only one of the lemniscate antenna elements in the array is connected to the associated electronic equipment, and partly because the range of frequencies to be covered usually is small enough that there is not a great difference in the sizes of the various lemniscate antenna elements in the array. Therefore, it is preferable and convenient have equal loop heights.

One problem with lemniscate log-periodic arrays, in this respect, is that the purpose of log-periodic arrays is to cover a relatively large range of frequencies. Therefore, the range of dimensions is relatively large. It is not unusual for the resonant frequency of the largest element in a log-periodic array to be one-half of the resonant frequency of the smallest element. One result of this is that if one tried to achieve that range of resonant frequencies with a constant height, it would be likely that the appropriate height of the largest lemniscate antenna element in the array for a desirable radiation pattern at the lower frequencies would be larger than the perimeter of the loops of the smallest element. Hence, such an equal-height array would be practicable only if the range of frequencies covered were not very large.

Another reason for the problem is that all of the individual lemniscate antenna elements are connected in a log-periodic array. Therefore, the relationship between the impedances of the elements is important. The problem of equal-height log-periodic designs is that the impedances of high and narrow lemniscate antenna elements are quite different from the impedances of short and wide versions. The design of the connecting system, which depends on those impedances, might be unduly complicated if these unequal impedances were taken into account. In addition, the design might be complicated by the fact that the radiation pattern would change if the ratio of the height to width were changed. Therefore, instead of using equal heights, it may be preferable to accept the poorer gain and poorer suppression of radiation to the rear resulting from the nonaligned conductors in order to use lemniscate antenna elements that are proportional to each other in height and width.

Sometimes, a compromise between the extremes of equal height and proportional dimensions is useful. For example, the resonant frequencies of adjacent lemniscate antenna elements may conform to a constant ratio, the conventional scale factor, but the heights may conform to some other ratio, such as the square root of the scale factor.

Applications—Log-Periodic Design Tactics

Whether equal-height lemniscate antenna elements or proportional dimensions are used, the design principles are similar to the traditional principles of log-periodic dipole arrays. However, the details would be different in some ways. The scale factor ($\tau$) and spacing factor ($\sigma$) usually are defined in terms of the dipole lengths, but there would be no such lengths available if the individual elements were not half-wave dipoles. It is better to interpret the scale factor as the ratio of the resonant wavelengths of adjacent lemniscate antenna elements. If the design were proportional, that also would be the ratio of any corresponding dimensions in the adjacent elements. For example, for the proportional array of FIG. 14, the scale factor would be the ratio of any dimension of the second largest element formed by parts 1409 and 1410 divided by the corresponding dimension of the largest element formed by parts 1411 and 1412. The spacing factor could be interpreted as the ratio of the individual space to the resonant wavelength of the larger of the two lemniscate antenna elements adjacent to that space. For example, the spacing factor would be the ratio of the space between the two largest lemniscate antenna elements to the resonant wavelength of the largest element.

Some other standard factors may need more than reinterpretation. For example, since the impedances of lemniscate antenna elements do not equal the impedances of dipoles, the usual impedance calculations for log-periodic dipole antennas are not very useful. Also, since the array uses some lemniscate antenna elements that are larger and some that are smaller than resonant elements at any particular operating frequency, the design must be extended to frequencies beyond the operating frequencies. For log-periodic dipole antennas, this is done by calculating a bandwidth of the active region, but there is no such calculation available for the lemniscate log-periodic array. Since the criteria used for determining this bandwidth of the active region were quite arbitrary, this bandwidth may not have satisfied all uses of logperiodic dipole antennas anyway.

However, if the array had a constant scale factor and a constant spacing factor, the elements were connected with a transmission line having a velocity of propagation near the speed of light, like open wire, and the connections were reversed between each pair of elements, the result would be some kind of log-periodic array. In FIG. 14, that transmission line is formed by the two feeder conductors 1425 and 1426. The connection reversal is achieved by alternately connecting the left and right sides of the lemniscate antenna elements to the top and bottom feeder conductors. For example, the left sides of the largest element, 1411 and 1412, are connected to the top feeder conductor, 1425, but the left sides of the second largest element, 1409 and 1410, are connected to the bottom feeder conductor, 1426. The frequency range, the impedance, and the gain of such an array may not be what the particular application requires, but nevertheless it will be a log-periodic array. The task is just to start with a reasonable trial design and to make adjustments to achieve an acceptable design.

This approach is practicable because computer programs allow us to test antennas before they exist. No longer is it necessary to be able to calculate the dimensions with reasonable accuracy because of the cost of building real antennas. Instead, the trial dimensions could be put into a computer spreadsheet, so that the mechanical results of changes could be seen almost instantly. If the results of those mechanical calculations seemed promising, an antenna simulating program could show whether the design were electrically acceptable to a reasonable degree of accuracy. Only after the computer testing has produced a reasonable design, would it be necessary to build real antennas for testing on the antenna range.

To get a trial log-periodic design, the procedure could be as follows. The known specifications would be the band of frequencies to be covered, the desired gain, the desired suppression of radiation to the rear, the desired length of the array, and the number of antenna elements that could be tolerated because of the weight and cost. Since the resonant frequencies of the largest and smallest lemniscate antenna elements could not be calculated, it would be necessary just to choose a pair of frequencies that would be reasonably beyond the actual operating frequencies. Then, given the minimum frequency ($f_{min}$), maximum frequency ($f_{max}$), length (L), and number of elements (N) and, using the geometry of the array, one could calculate the scale factor ($\tau$) and the spacing factor ($\sigma$).

$$\tau=(f_{min}/f_{max})^{[1/(N-1)]}$$

The calculation of $\sigma$ requires the calculation of the wavelength of the largest lemniscate antenna element. Of course, this could be done in any units, but this maximum wavelength and the length of the array must be in the same units.

$\lambda_{max}=9.84\times10^8/f_{min}$ ft or $\lambda_{max}=3\times10^8/f_{min}$ m $\sigma=[L(1-\tau)]/[\lambda_{max}(1-f_{min}/f_{max})]$ Once a mechanical design was revealed by these calculations, it should be tested for electrical performance by an antenna simulating program. The largest lemniscate antenna element would be designed using the maximum wavelength ($\lambda_{max}$). The resonant wavelengths and dimensions of the remaining elements would be obtained by successively multiplying the wavelengths and the dimensions by the scale factor. The spaces between the elements would be obtained by multiplying the wavelength of the larger adjacent element by the spacing factor. An additional factor needed for the program would be the distance between the feeder conductors. For good operation this distance should produce a relatively high characteristic impedance. Unless the scale factor were rather high, a minimum characteristic impedance of 200 ohms perhaps would be prudent. Because the boom (1427) is a part of the feeding system in FIG. 14, that criterion would be at least 100 ohms between either feeder conductor and the boom.

The gain, front-to-back ratio, and standing wave ratio of this first trial probably would indicate that the upper and lower frequencies were not acceptable. At least, the spacing between the feeder conductors probably should be modified to produce the best impedance across the band of operating frequencies. With this information, new values would be chosen to get a second trial design.

What is an acceptable performance is, of course, a matter of individual requirements and individual standards. For that reason, variations from the original recommended practice are common. For example, although the extension of the feeder conductors behind the largest lemniscate antenna element was recommended in early literature to improve the performance at the lowest frequency, it is seldom used. The original recommendation was that it should be about an eighth of a wavelength long at the lowest frequency and terminated in the characteristic impedance of the feeder conductors, which is represented by the resistance symbol 1428. It is more common practice to make the termination a short circuit. If the antenna were designed for proper operation, the conventional wisdom seems to be that the current in the termination would be very small anyway, so the termination would do very little and usually could be eliminated. However, there are some reports that the performance at twice the lowest frequency would be impaired if the extension were not used.

Actually, extending or not extending the feeder conductors may not be the significant choice. There may be a limit to the length of the feeder conductors. In that case, the choice may be whether it is better to have an extension or more elements. Note that because the boom is a part of the feeding system in FIG. 14, it must be extended as well.

The log-periodic array of FIG. 14 illustrates the appropriate connecting points, F, to serve a balanced transmission line leading to the associated electronic equipment. Other tactics for feeding unbalanced loads and higher impedance balanced loads also are used with log-periodic dipole antennas. Because these tactics depend only on some kind of log-periodic array connected to two parallel tubes, these conventional tactics are as valid for such an array of lemniscate antenna elements as they are for such arrays of half-wave dipoles.

Applications—Large Arrays

Both Yagi-Uda arrays and log-periodic arrays of lemniscate antenna elements can be used in the ways that such arrays of half-wave dipoles are used. For example, FIG. 12 shows two end-fire arrays that are oriented to produce elliptically polarized radiation. For another example, FIG. 13 shows two Yagi-Uda arrays oriented so that the corresponding lemniscate antenna elements of the two arrays are in the same vertical planes. In this case, there is a collinear orientation, because the array is extended in the direction of principal E plane. The arrays also could be oriented in the direction of the principal H plane (broadside), or several arrays could be arranged in both orientations.

Since the gain of such large arrays tends to depend on the overall area of the array facing the direction of maximum radiation, it is unrealistic to expect much of a gain advantage from using lemniscate antenna elements in large arrays of a particular overall size. However, there are other advantages. Since the individual arrays in the overall array could have more gain if they were composed of lemniscate antenna elements, the feeding system could be simpler because fewer individual arrays would be needed to fill the overall space adequately. In addition, the superior ability of the lemniscate antenna elements to suppress received signals arriving from undesired directions is a considerable advantage when the desired signals are small. For communication by reflecting signals off the noon, the ability to suppress undesired signals and noise is a great advantage.

It is well known that there is some minimum spacing needed between the individual antenna elements in collinear or broadside arrays so that the gain of the whole array will be maximized. If the beam width of the individual elements were narrow, that minimum spacing would be larger than if the beam width were wide. In other words, if the gain of the individual elements were large, the spacing between them would be large. Large spacing, of course, increases the cost and weight of the supporting structure.

Because the half-wave dipole has no directivity in the principal H plane, Yagi-Uda arrays of half-wave dipoles usually have wider beam widths in the principal H plane than in the principal E plane. Therefore, the spacing necessary to obtain the maximum gain from two such arrays would be less for a broadside array than for a collinear array. That is, for a horizontally polarized array, it would be better from a cost and weight point of view to place the two arrays one above the other instead of one beside the other. The lemniscate antenna element presents the opposite situation. Because the latter element produces considerable directivity in the principal H plane, a Yagi-Uda array of them would have a narrower beam in the principal H plane than in the principal E plane. Therefore, it would be better to place two such arrays in a collinear array, as in FIG. 13, rather than in a broadside array. Of course, mechanical or other considerations may make other choices preferable.

It also is unrealistic to expect that long Yagi-Uda arrays of lemniscate antenna elements will have a large gain advantage over long Yagi-Uda arrays of half-wave dipoles. The principle of a minimum necessary spacing applies here as well. It is not exactly true, but one can consider that the lemniscate antenna elements comprise curved dipoles, represented by the outer ends of the loops, joined by the rest of the loops. Presented in that manner, a Yagi-Uda array of lemniscate antenna elements could be considered equivalent to a broadside array two Yagi-Uda arrays of curved dipoles.

Each of these two Yagi-Uda arrays could have some beam width in the principal H plane and, therefore, these arrays should be separated by some minimum distance to produce the maximum gain for the combination. The longer the Yagi-Uda array is, of course, the narrower the individual H-plane beams would be and the greater the spacing should be. That is, since the spacing is limited by the need to have approximately one-wavelength loops, a long Yagi-Uda array of lemniscate antenna elements would not have as much gain as one might expect. In particular, a long array of such elements may not have much advantage at all over an array of half-wave dipoles of equal length.

That situation raises the question of how long Yagi-Uda arrays should be. One factor is that there usually is an advantage to making Yagi-Uda arrays of four lemniscate antennas elements because four elements usually are required to produce an excellent suppression of the radiation to the rear of the array. Beyond that array length, the increase in gain for the increase in length probably will be disappointing. That is, the usual expectation that doubling the length producing twice the gain will not be realized. It probably would be wiser to employ more than one Yagi-Uda array of lemniscate antenna elements in a larger collinear or broadside array.

CONCLUSION

Except for the restrictions of size, weight, and cost, lemniscate antenna elements could be used for almost whatever purposes that antennas are used. Beside the obvious needs to communicate sound, pictures, data, etc., they also could be used for such purposes as radar or for detecting objects near them for security purposes. Since they are much larger than half-wave dipoles, it would be expected that they would generally not be used at the lower end of the high-frequency spectrum. However, they may not be considered to be too large for short-wave broadcasting because that service typically uses very large antennas.

While this invention has been described in detail, it is not restricted to the exact embodiments shown. These embodiments serve to illustrate some of the possible applications of the invention rather than to define the limitations of the invention.

I claim:

1. An antenna element, comprising:

(a) two conducting loops, with perimeters of approximately one wavelength of operation, disposed in approximately the same plane from a common proximal point, such that the distance from said proximal point to any point on said conducting loops is approximately equal to the expression $$r=h|\cos(m\theta)|^p$$

wherein θ is the angle in said plane between an imaginary line from said proximal point to any point on said conducting loops and an imaginary line from said proximal point to the distal point on a first one of said conducting loops, θ has values between $-\pi/2m$ and $\pi/2m$ radians for said first one of said conducting loops, θ has values between $(\pi-\pi/2m)$ and $(\pi+\pi/2m)$ radians for the remaining second one of said conducting loops, m is a positive number greater than one, p is a non-negative number, h is the distance from said proximal point to said distal point on said first one of said conducting loops, and r is said distance from said proximal point to any point on said conducting loops; and (b) means for connecting the associated electronic equipment effectively in series with each of said two conducting loops, and effectively at said proximal point, so that current maxima are present approximately at the distal points and approximately at said proximal point on said conducting loops, and single current minima are present on said conducting loops between said current maxima.

2. The antenna element of claim 1 wherein the dimensions of said antenna element are chosen to maximize the transmitting and receiving ability of said antenna element in the direction perpendicular to said plane of said antenna element.

3. The antenna element of claim 1 wherein the dimensions of said antenna element are chosen to minimize the transmitting and receiving ability of said antenna element in the two directions, in said plane of said antenna element, that are parallel to said imaginary line from said proximal point to said distal point on said first one of said conducting loops.

4. The antenna element of claim 1 wherein the dimensions of said antenna element are chosen to produce a beneficial compromise between maximizing the transmitting and receiving ability of said antenna element in the direction perpendicular to said plane of said antenna element while minimizing said transmitting and receiving ability in other directions.

5. The antenna element of claim 1 wherein the value of p approximately equals zero.

6. The antenna element of claim 1 wherein at least one of the conductors has a circular cross-sectional area.

7. The antenna element of claim 1 wherein at least one of the conductors has a solid cross-sectional area.

8. The antenna element of claim 1 wherein at least one of the conductors has a tubular cross-sectional area.

9. The antenna element of claim 1 wherein the conductors have equal crosssection sectional areas.

10. The antenna element of claim 1 wherein not all of the conductors have equal cross-sectional areas.

11. The antenna element of claim 1, further including two approximately straight supporting conductors connected between said proximal point and said distal point on said first one of said conducting loops, and between said proximal point and the distal point of said second one of said conducting loops.

12. The antenna element of claim 11 where in said supporting conductors are grounded.

13. The antenna element of claim 1 wherein the principal H plane is disposed approximately parallel to the surface of the earth.

14. The antenna element of claim 1 wherein the principal H plane is disposed approximately perpendicular to the surface of the earth.

15. The antenna element of claim 1 wherein t he principal H plane is disposed neither approximately parallel to the surface of the earth nor approximately perpendicular to the surface of the earth.

16. An antenna element comprising four conducting loops, with perimeters of approximately one wavelength of operation, such that:

(a) a first point of origin and a second point of origin are disposed on opposite sides of the proximal point;

b) said points of origin are approximately aligned in the direction of the desired maximum of transmitting or receiving ability and are separated by a distance much smaller than one wavelength of operation;

(c) said conducting loops are disposed approximately in a plane perpendicular to an imaginary line between s aid points of origin;

(d) the distance from said proximal point to any point on said conducting loops is approximately equal to the expression $$r=h|\cos(m\theta)|^p$$

wherein r is said distance from said proximal point to any point on any one of said conducting loops, h is the distance from said proximal point to the distal point on a first one of said conducting loops, p is a non-negative number, m is a positive number greater than one, and θ is the angle in said plane between an imaginary line from said proximal point to any point on said conducting loops and an imaginary line from said proximal point to said distal point on said first one of said conducting loops;

(e) said first one of said conducting loops begins at said first point of origin and ends at said second point of origin and is such that θ has values between $-\pi/2m$ and $\pi/2m$ radians;

(f) a second one of said conducting loops begins at said second point of origin and ends at said first point of origin and is such that θ has values between $-\pi/2m$ and $\pi/2m$ radians;

(g) a third one of said conducting loops begins at said first point of origin and ends at said second point of origin and is such that θ has values between $(\pi-\pi/2m)$ and $(\pi+\pi/2m)$ radians;

(h) a fourth one of said conducting loops begins at said second point of origin and ends at said first point of origin and is such that θ has values between $(\pi-\pi/2m)$ and $(\pi+\pi/2m)$ radians;

(i) except perhaps at said points of origin, said conducting loops do not touch each other; and (j) there is a means for connecting the associated electronic equipment effectively in series with said conducting loops, effectively at either one of said points of origin, so that current maxima are present approximately at the distal points and approximately at said points of origin on said conducting loops, and single current minimal are present on said conducting loops between said current maxima.

17. An antenna system comprising at least one antenna, each of said antennas comprising two antenna elements, such that:

(a) in each of said antenna elements, there are two conducting loops, with perimeters of approximately one wavelength of operation, disposed in approximately the same plane from a common proximal point, such that the distance from said proximal point to any point on said conducting loops is approximately equal to the expression $$r=h|\cos(m\theta)|^p$$

wherein θ is the angle in said plane between an imaginary line from said proximal point to any point on said conducting loops and an imaginary line from said proximal point to the distal point on a first one of said conducting loops, θ has values between $-\pi/2m$ and $\pi/2m$ radians for said first one of said conducting loops, θ has values between $(\pi-\pi/2m)$ and $(\pi+\pi/2m)$ radians for the remaining second one of said conducting loops, m is a positive number greater than one, p is a non-negative number, h is the distance from said proximal point to said distal point on said first one of said conducting loops, and r is said distance from said proximal point to any point on said conducting loops;

(b) in each of said antennas, said planes of said two antenna elements are approximately perpendicular to each other;

(c) in each of said antennas, the intersection of said two planes forms a line that passes much closer to the proximal points of said two antenna elements than the length of a wavelength of operation and passes much closer to the distal points of said two antenna elements than the length of a wavelength of operation;

(d) in each of said antennas, except perhaps at said proximal points and said distal points, said two antenna elements do not touch each other;

(e) means is provided for connecting the associated electronic equipment effectively in series with each of said conducting loops, and effectively at said proximal points, so that current maxima are present approximately at said distal points and approximately at said proximal points on said conducting loops, and single current minima are present on said conducting loops between said current maxima; and (f) in each of said antennas, said means also is such that the currents at corresponding points of said two antenna elements are consistently related in amplitude by approximately equal ratios of values and are consistently unequal in phase by approximately equal amounts.

18. The antenna system of claim 17 wherein the amplitudes of said currents at said corresponding points of said two antenna elements, of each of said antennas, are approximately equal and the phases of said currents are consistently unequal by approximately 90 degrees.

19. The antenna system of claim 17 wherein there is only one antenna.

20. The antenna system of claim 17 wherein:

(a) there is more than one of said antennas in said antenna system; and (b) said antennas are aligned so that the line of intersection of said two planes of each of said antennas approximately is the line of intersection of said two planes of the other antennas in said antenna system.

21. The antenna system of claim 20 wherein the relative amplitudes and phases of said currents at corresponding points of said antennas and the distances between said antennas are such that the transmitting and receiving ability is maximized in the principal E plane.

22. The antenna system of claim 20 wherein the relative amplitudes and phases of said currents at corresponding points of said antennas and the distances between said antennas are such that the transmitting and receiving ability is minimized in directions other than in the principal E plane.

23. The antenna system of claim 20 wherein the relative amplitudes and phases of said currents at corresponding points of said antennas and the distances between said antennas are such that the transmitting and receiving ability is a beneficial compromise between maximizing said transmitting and receiving ability in the principal E plane and minimizing said transmitting and receiving ability in other directions.

24. An antenna system comprising at least one antenna, each of said antennas comprising at least one antenna element, such that:

(a) in each of said antenna elements, there are two conducting loops, with perimeters of approximately one wavelength of operation, disposed in approximately the same plane from a common proximal point, such that the distance from said proximal point to any point on said conducting loops is approximately equal to the expression $$r=h\,|\cos(m\theta)|^p$$

wherein θ is the angle in said plane between an imaginary line from said proximal point to any point on said conducting loops and an imaginary line from said proximal point to the distal point on a first one of said conducting loops, θ has values between $-\pi/2m$ and $\pi/2m$ radians for said first one of said conducting loops, θ has values between $(\pi-\pi/2m)$ and $(\pi-\pi/2m)$ radians for the remaining second one of said conducting loops, m is a positive number greater than one, p is a non-negative number, h is the distance from said proximal point to said distal point on said first one of said conducting loops, and r is said distance from said proximal point to any point on said conducting loops;

(b) said antenna elements, within each of said antennas, are disposed in planes approximately parallel to each other;

(c) said antenna elements, within each of said antennas, are disposed so that their principal H planes are approximately parallel to each other; and (d) means is provided to connect the associated electronic equipment effectively in series with each of said two conducting loops, and effectively at said proximal points, of at least one of said antenna elements in each of said antennas, so that current maxima are present approximately at said distal points and approximately at said proximal points on said conducting loops, and single current minima are present on said conducting loops between said current maxima.

25. The antenna system of claim 24, further including a reflecting screen disposed behind said antenna system to produce a substantially unidirectional transmitting and receiving ability to the front of said antenna system in the direction approximately perpendicular to said planes of said antenna elements.

26. The antenna system of claim 24 wherein there is only one of said antennas in said antenna system.

27. The antenna system of claim 24 wherein there is more than one antenna in said antenna system.

28. The antenna system of claim 27 wherein:

(a) said antenna elements, of all of said antennas, are disposed so that their principal H planes are approximately parallel to each other; and (b) said antennas are approximately aligned both in the direction of said planes of said antenna elements and in the direction perpendicular to said principal H planes.

29. The antenna system of claim 27 wherein:

(a) said antenna elements, of all of said antennas, are disposed so that their principal H planes are approximately parallel to each other; and (b) said antennas are approximately aligned both in the direction of said planes of said antenna elements and in the direction parallel to said principal H planes.

30. The antenna system of claim 27 wherein:

(a) said antenna elements, of all of said antennas, are disposed so that their principal H planes are approximately parallel to each other; and (b) said antennas are approximately aligned both in the direction of said planes of said antenna elements and both in the direction parallel and in the direction perpendicular to said principal H planes, thereby producing a rectangular antenna system.

31. The antenna system of claim 27 wherein the relative amplitude and phase of the currents in said antennas and the distances between said antennas are chosen to maximize the transmitting and receiving ability to the front of said antenna system.

32. The antenna system of claim 27 wherein the relative amplitude and phase of the currents in said antennas and the distances between said antennas are chosen to minimize the transmitting and receiving ability in directions other than to the front of said antenna system.

33. The antenna system of claim 27 wherein the relative amplitude and phase of the currents in said antennas and the distances between said antennas are chosen to produce a beneficial compromise between maximizing the transmitting and receiving ability to the front of said antenna system and minimizing said transmitting and receiving ability in other directions.

34. The antenna system of claim 24 wherein there is only one of said antenna elements in each of said antennas.

35. The antenna system of claim 24 wherein:

(a) there is more than one of said antenna elements in each of said antennas; and (b) the proximal points of said antenna elements, within each of said antennas, are approximately aligned in the direction perpendicular to said planes of said antenna elements.

36. The antenna system of claim 35 wherein in each of said antennas:

(a) there are just two of said antenna elements, with substantially equal dimensions;

(b) both of said antenna elements are connected to said associated electronic equipment; and (c) said means of connection to said associated electronic equipment also is such that the currents in corresponding conductors of said two antenna elements are approximately equal in amplitude and approximately 180 degrees out of phase with each other.

37. The antenna system of claim 35 wherein in each of said antennas:

(a) there are just two of said antenna elements, with substantially equal dimensions;

(b) both of said antenna elements are connected to said associated electronic equipment;

(c) said means of connection to said associated electronic equipment also is such that the currents in corresponding conductors of said two antenna elements are approximately equal in amplitude; and (d) the distance between said antenna elements and the phase difference between said currents in said corresponding conductors are such that the radiation is minimized in one of the two directions perpendicular to said planes of said antenna elements.

38. The antenna system of claim 37 wherein in each of said antennas:

(a) the distance between said antenna elements is approximately a free-space quarter wavelength of operation; and (b) the phase difference between said currents in said corresponding conductors is approximately a consistent 90 degrees.

39. The antenna system of claim 35 wherein in each of said antennas:

(a) there are just two antenna elements in each of said antennas;

(b) only the rear antenna elements are connected to said associated electronic equipment; and (c) the dimensions of said antenna elements and the distances between said antenna elements are such that the transmitting and receiving ability is substantially unidirectional to the front of said antenna system.

40. The antenna system of claim 35 wherein:

(a) there is an even number of said antennas in said antenna system; and (b) said antennas are substantially the same as each other in the dimensions of their antenna elements and the distances between their antenna elements.

41. The antenna system of claim 40 wherein:

(a) a first half of said antennas has its principal H planes oriented approximately perpendicular to the principal H planes of the remaining second half of said antennas;

(b) said antennas are disposed in pairs, each of said pairs comprising said antennas having principal H planes of the two orientations;

(c) said antennas also are disposed so that said proximal points of the corresponding antenna elements, in each of said pairs, are much closer to each other than the length of a wavelength of operation; and (d) said means of connection to said associated electronic equipment also is such that the currents in the conductors of said first half of said antennas are approximately equal in amplitude and consistently out of phase by approximately 90 degrees to the currents in corresponding conductors of said second half of said antennas, thereby producing an approximately circularly polarized antenna system.

42. The antenna system of claim 40 wherein:

(a) a first half of said antennas has principal H planes that are oriented approximately perpendicular to the principal H planes of the remaining second half of said antennas;

(b) said antennas are disposed in pairs, each of said pairs comprising said antennas having principal H planes of the two orientations;

(c) said proximal points of said antenna elements, in both of said antennas in each of said pairs, are approximately aligned with each other;

(d) said means of connection to said associated electronic equipment also is such that the currents in corresponding conductors, in each of said pairs, are approximately equal in amplitude; and (e) the perpendicular distances between said planes of the corresponding antenna elements, in each of said pairs of said antennas, and the phase relationship between the corresponding currents, in each of said pairs of antennas, are such that approximately circularly polarized radiation is produced to the front of said antenna system.

43. The antenna system of claim 35 wherein:

(a) only the second antenna element from the rear of each of said antennas is connected to said associated electronic equipment; and (b) in each of said antennas, the dimensions of said antenna elements and the distances between said antenna elements are such that the transmitting and receiving ability is substantially unidirectional to the front of said antenna system.

44. The antenna system of claim 43 wherein the dimensions of said antenna elements and the distances between said antenna elements produce the maximum transmitting and receiving ability in the direction to the front of said antenna system.

45. The antenna system of claim 43 wherein the dimensions of said antenna elements and the distances between said antenna elements produce the minimum transmitting and receiving ability in directions other than in the direction to the front of said antenna system.

46. The antenna system of claim 43 wherein the dimensions of said antenna elements and the distances between said antenna elements produce a beneficial compromise between maximizing the transmitting and receiving ability in the direction to the front of said antenna system and minimizing said transmitting and receiving ability in other directions.

47. The antenna system of claim 35 wherein:

(a) the resonant frequencies of said antenna elements are progressively and proportionally higher from the rear to the front of each of said antennas;

(b) the distances between said antenna elements are progressively and proportionally shorter from the rear to the front of each of said antennas;

(c) within each of said antennas, the ratio of said resonant frequencies of all the adjacent antenna elements and the ratio of all the adjacent distances between said antenna elements are approximately equal ratios;

(d) within each of said antennas, all of said antenna elements are connected to each other, effectively at said proximal points, so that the phase relationship produced by the time taken for the energy to travel between said antenna elements, by that connection, is substantially equal to the phase relationship that is consistent with travel at the speed of light;

(e) said connection between said antenna elements also produces, in addition to the phase difference caused by the travelling time of the energy, an additional phase reversal between said adjacent antenna elements; and (f) the antenna elements at the front of each of said antennas are connected to said associated electronic equipment.

48. The antenna system of claim 47 wherein the differences in said resonant frequencies are caused by all the dimensions of said antenna elements approximately being proportionally different.

49. The antenna system of claim 47 wherein:

(a) the heights of each of said antenna elements are all approximately equal; and (b) the differences in said resonant frequencies are caused by the widths of said antenna elements being different.

50. The antenna system of claim 47 wherein the method of producing said proportional resonant frequencies is a compromise between having all the dimensions of said antenna elements proportional to each other and having equal heights in each of said antenna elements.

* * * * *